US012326286B2

(12) United States Patent
Spence

(10) Patent No.: US 12,326,286 B2
(45) Date of Patent: Jun. 10, 2025

(54) APPARATUS FOR MAKING CLEAR MOLDED ICE, AND CORRESPONDING METHODS

(71) Applicant: Christopher Spence, Colchester, CT (US)

(72) Inventor: Christopher Spence, Colchester, CT (US)

( * ) Notice: Subject to any disclaimer, the term of this patent is extended or adjusted under 35 U.S.C. 154(b) by 380 days.

(21) Appl. No.: 17/854,041

(22) Filed: Jun. 30, 2022

(65) Prior Publication Data

US 2024/0003608 A1 Jan. 4, 2024

(51) Int. Cl.
*F25C 1/22* (2018.01)
*F25C 1/18* (2006.01)

(52) U.S. Cl.
CPC . *F25C 1/18* (2013.01); *F25C 1/22* (2013.01)

(58) Field of Classification Search
None
See application file for complete search history.

(56) References Cited

U.S. PATENT DOCUMENTS

| | | | | |
|---|---|---|---|---|
| 2,545,592 | A * | 3/1951 | Sherbloom | A23G 9/221 249/55 |
| 4,550,575 | A * | 11/1985 | DeGaynor | F25C 1/18 264/28 |
| 8,057,207 | B2 | 11/2011 | Zorovich et al. | |
| 8,430,658 | B2 | 4/2013 | Zorovich et al. | |
| D689,746 | S | 9/2013 | Zorovich et al. | |
| 8,961,163 | B2 | 2/2015 | Zorovich et al. | |
| 9,272,444 | B2 | 3/2016 | Zorovich et al. | |
| 9,784,492 | B2 | 10/2017 | Little et al. | |
| 10,151,519 | B2 | 12/2018 | Little et al. | |
| 10,443,915 | B2 | 10/2019 | Little et al. | |
| D910,723 | S | 2/2021 | Little et al. | |
| 2013/0269371 | A1 | 10/2013 | Lee et al. | |
| 2017/0038112 | A1 | 2/2017 | Papalia | |
| 2017/0307271 | A1 | 10/2017 | Myers | |
| 2019/0353415 | A1 | 11/2019 | Henderson et al. | |
| 2020/0072522 | A1* | 3/2020 | Murphy | F25C 1/22 |
| 2020/0370810 | A1 | 11/2020 | Little et al. | |
| 2021/0381738 | A1* | 12/2021 | Cran | F25C 1/25 |

FOREIGN PATENT DOCUMENTS

| | | | |
|---|---|---|---|
| CN | 111 854 251 | A * | 10/2020 |
| WO | 2015189069 | A1 | 12/2015 |
| WO | 2017216294 | A1 | 12/2017 |

OTHER PUBLICATIONS

Dramson, "Crystal-Clear Sphere Ice Maker," retrieved from https://dramson.com/collections/bar-ice before Jun. 30, 2022.

(Continued)

*Primary Examiner* — Mohammad M Ameen
(74) *Attorney, Agent, or Firm* — Alix, Yale & Ristas, LLP

(57) ABSTRACT

A mold extractor is described that includes a mold support configured to contact at least a first end portion of an ice mold during use, and an extracting component configured to be manually lifted by a user to remove the ice mold from a vessel, the extracting component comprising at least one of a handle connected to the mold support with an upwardly extending gripping portion, and a flange formed at an upper end of the mold support. Corresponding systems and methods also are disclosed.

20 Claims, 35 Drawing Sheets

(56) References Cited

OTHER PUBLICATIONS

Corkcicle, "Invisiball Kit," retrieved from https://corkcicle-dev.myshopify.com/products/invisiball-kit before Jun. 30, 2022.
LushICE, "Gourmet Ice for Cooler Cocktails," retrieved from https://www.luxurylushice.com/ before Jun. 30, 2022.
Meltdown Ice, "Vamoose Clear Ice Device," retrieved from https://meltdownice.com/product/vamoose-clear-ice-device/ before Jun. 30, 2022.
Crystal Cubes, LLC, "True Cubes Tray," retrieved from https://www.truecubes.com/ before Jun. 30, 2022.
Ghost Ice System, "Ghost Ice Compact," retrieved from https://www.ghosticesystem.com/ before Jun. 30, 2022.
International Search Report and Written Opinion mailed Nov. 17, 2023 for International Patent Application No. PCT/US2023/069151.

* cited by examiner

APPARATUS FOR MAKING CLEAR MOLDED ICE, AND CORRESPONDING METHODS

BACKGROUND

This disclosure relates generally to making ice, and more particularly to an apparatus and method for making clear molded ice.

Most food-grade ice is cloudy due to the presence of trapped air bubbles and minerals, such as calcium and magnesium. While cloudy ice does not present any health concerns, servers and consumers of cold beverages often prefer the use of clear ice due to its aesthetically pleasing appearance.

The melting rate of beverage ice will depend on the shape and size of the pieces of ice that are used. Spheres are beneficial when a slow melt rate is desired. However, the process of making of spherical ice is more complicated than processes used to make cubed ice.

It would be useful to develop additional devices and methods for making clear ice spheres, cubes and other shapes for use in cold beverages.

SUMMARY

One embodiment described herein is a mold extractor comprising a mold support configured to contact at least a first end portion of an ice mold during use, and an extracting component configured to be manually lifted by a user to remove the ice mold from a vessel. The extracting component comprises at least one of a handle connected to the mold support and having an upwardly extending gripping portion, and a flange formed at an upper end of the mold support.

Another embodiment described herein is an assembly comprising an ice mold having a cavity configured to produce shaped, clear ice, the ice mold including a first end portion and an opposite second end portion, a mold support configured to contact at least the first end portion of the ice mold, the mold support including a cup portion configured to hold the assembly in an insulated vessel in a stationary position, and an extracting component. The extracting component includes at least one of a handle connected to the mold support and having a gripping portion extending beyond the second end portion of the mold, and a flange formed at an upper end of at least one of the mold and the mold support.

Yet another embodiment is a method of making molded clear ice comprising obtaining an apparatus comprising a mold support and an extracting component, the extracting component comprising at least one of a handle connected to the mold support with an upwardly extending gripping portion, and a flange formed at an upper end of the mold support. An ice mold is placed on the mold support. The method further includes obtaining a vessel configured to receive the ice mold, mold support and extracting component, and placing the ice mold, mold support and extracting component in the vessel. Liquid, such as water, is added to the vessel such that the apparatus is at least partially submerged in the liquid, and the liquid is frozen using directional freezing to obtain clear ice. In embodiments, the method further comprises removing the apparatus from the insulated vessel by manually lifting the mold extractor.

DETAILED DESCRIPTION

Figure 1:
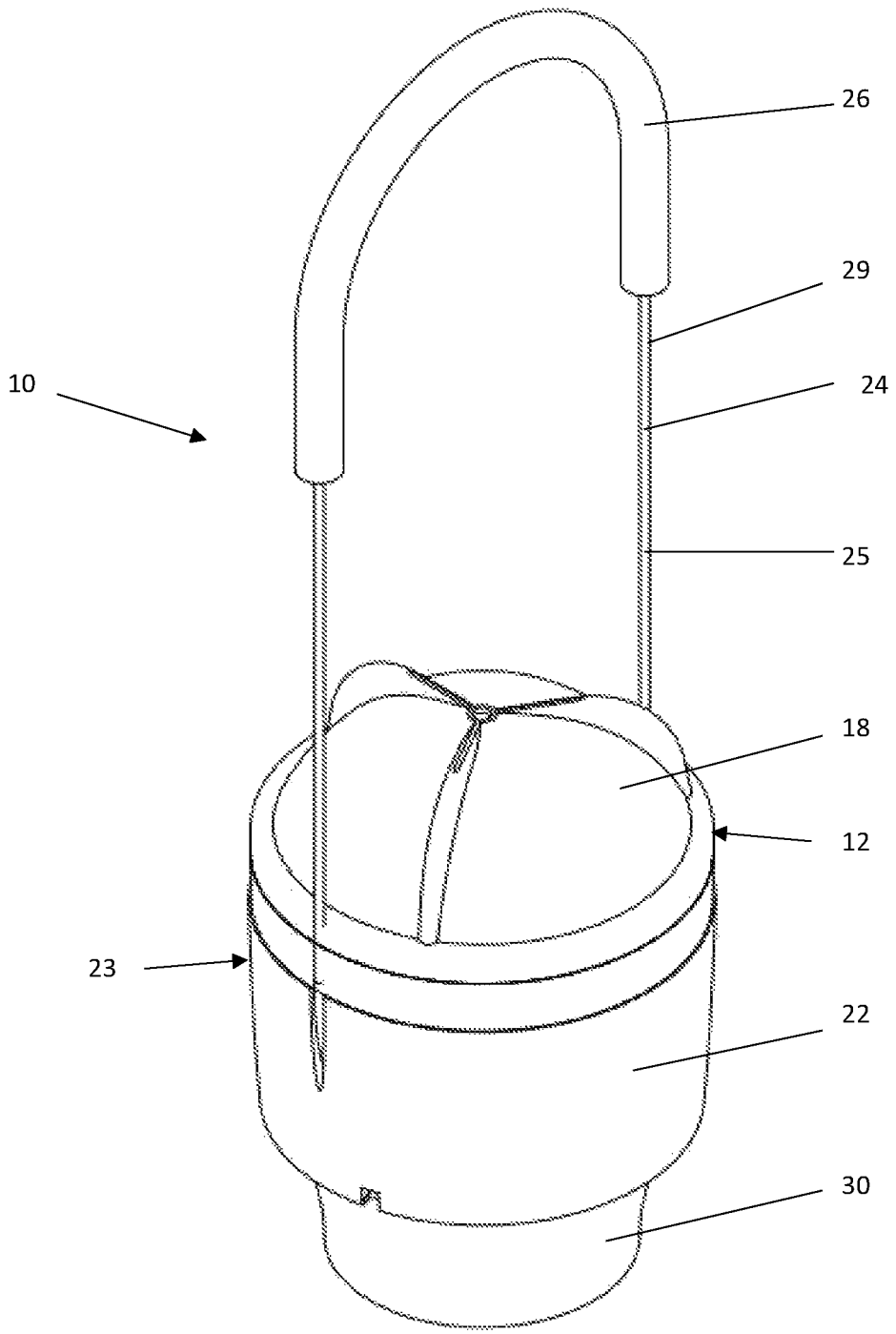
FIG. 1 shows a perspective view of a first embodiment described herein.

Traditional ice molds allow water to freeze from all sides, trapping air, minerals and other impurities within the ice and, as a result, the ice is cloudy. Prior known devices used to make clear ice require specialized containers and typically use large amounts of freezer space. The embodiments disclosed herein overcome the drawbacks of known devices by providing compact, versatile molding components that can be used in combination with commercially available insulated containers, or with customized containers, using principles of directional freezing to obtain clear, pure ice.

In embodiments, especially when the tops of the molds are not rectangular or cylindrical, the mold assembly can be configured to allow the mold to be fully submerged. Submerging the mold provides that the ice forms completely and uniformly within the mold. Water on top of the mold helps to maintain mold shape for multiple uses over time, while also providing for high clarity of the ice resulting from controlled pressure within the vessel. More specifically, a thin layer of ice on top of the mold helps to insulate the ice from the thaw/temper period to allow for easy extraction of the mold from the vessel, as the sides of the mold likely will thaw and therefore loosen before the top layer of ice is fully melted. In products that do not have a thin layer of ice on top, the shaped ice begins to melt first from the top. In some cases, extraction is difficult because the user is required to twist and pull the mold handle quickly to prevent the molded ice from melting. In some cases, the thickness of the ice layer on top of the mold (at the thinnest point) is in the range of about ⅛ inch to % inch, or about ⅜ inch to about ⅜ inch.

The disclosed embodiments utilize the interior walls of the insulated vessel for support during the freezing process. The vessel limits mold movement that otherwise could distort the ice shapes due to expansion that takes place in the phase change of liquid water into solid ice, as the volume of water expands by about 9% when it freezes. Certain embodiments of the disclosed mold assembly prevent the likelihood that the molds will float, and allow for optimal mold positioning with a particular insulated vessel for which a mold assembly was designed, positioning the mold such that it is neither too high or too low in the vessel.

In some embodiments, integrated air pockets within the hollow extractor and a tuned "cushion sleeve" control and leverage the pressure that naturally develops inside the vessel during the freezing process, optimizing the conditions for clear ice formation and reducing the potential for vessel damage if the liquid is left to freeze for too long. The air pockets also help to make extraction faster and easier by harnessing the pressure developed during the process.

Some of the disclosed embodiments employ an integrated vent to eliminate the potential for vacuum formation during the extraction process which otherwise can make it difficult to pull out the mold even when proper thawing has taken place.

In some cases, the extraction handle comprises a wire rope made from a metal such as stainless steel or the like. The wire rope handle allows for a sanitary and secure method of extraction. As compared to other designs, the disclosed embodiments allow a user to hold the vessel in one hand and the wire rope handle in the other hand in a clenched fist and maintain a position close to their body to get adequate leverage and maintain precise control during the extraction process.

Some of the disclosed embodiments are configured to form cylindrical or rectangular ice slugs that can then be shaped using known ice presses. Other embodiments contain molds in order to directly obtain shaped ice.

A refreeze adapter is provided as an accessory. The adapter allows the user to rinse, save and re-use shaped ice, and also allows for a preliminary rinse prior to use of the shaped ice. A pre-rinse can be performed to melt away witness marks from the mold, or other superficial imperfections. In some cases, an adapter configured to support an elongated member such as a toothpick is included as an accessory, allowing the user to support or suspend fruit or other garnishes inside a piece of shaped ice.

Referring to the drawings and first to FIGS. 1-7, a mold assembly for making clear, spherically shaped ice is shown and a generally designated as 10. The mold assembly 10 includes a mold 12 with a cavity 14 defined by an interior wall 15 configured to produce clear, shaped ice of a particular shape. The mold 12 shown in FIGS. 1-7 is configured to make ice spheres and thus the cavity 14 has a spherical shape. The mold includes a lower first portion 16 with a lower first end portion 17 and a complementary upper second portion 18 with an upper second end portion 19 having an aperture 27 that allows of the mold 12 to be filled with liquid. The first and second end portions 16, 18 define a ring-shaped parting line 21 therebetween along which the first and second portions 16,18 meet when the mold is closed. In the embodiment shown in the figures, the first and second mold portions do not have identical sizes, as the lower first portion 16 contains about 60 wt % of the ice and the upper second portion 18 contains about 40 wt % of the ice. In other embodiments, the first and second mold portions form approximately equal sized mold halves, or have of a variety of different relative sizes. As used in this application, the terms "upper" and "lower" refers to the apparatus or assembly as they are positioned in the figures.

Figure 2:
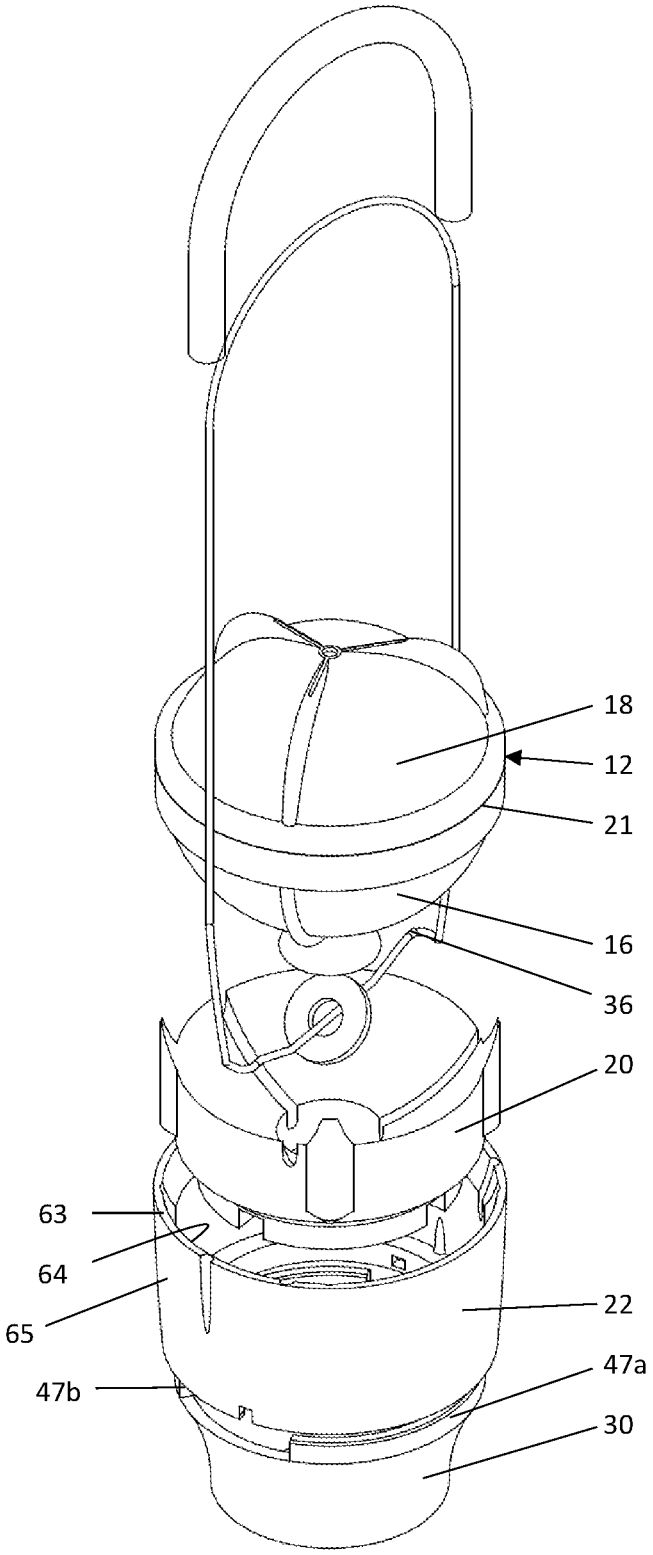
FIG. 2 is an exploded perspective view of the first embodiment.
Figure 3:
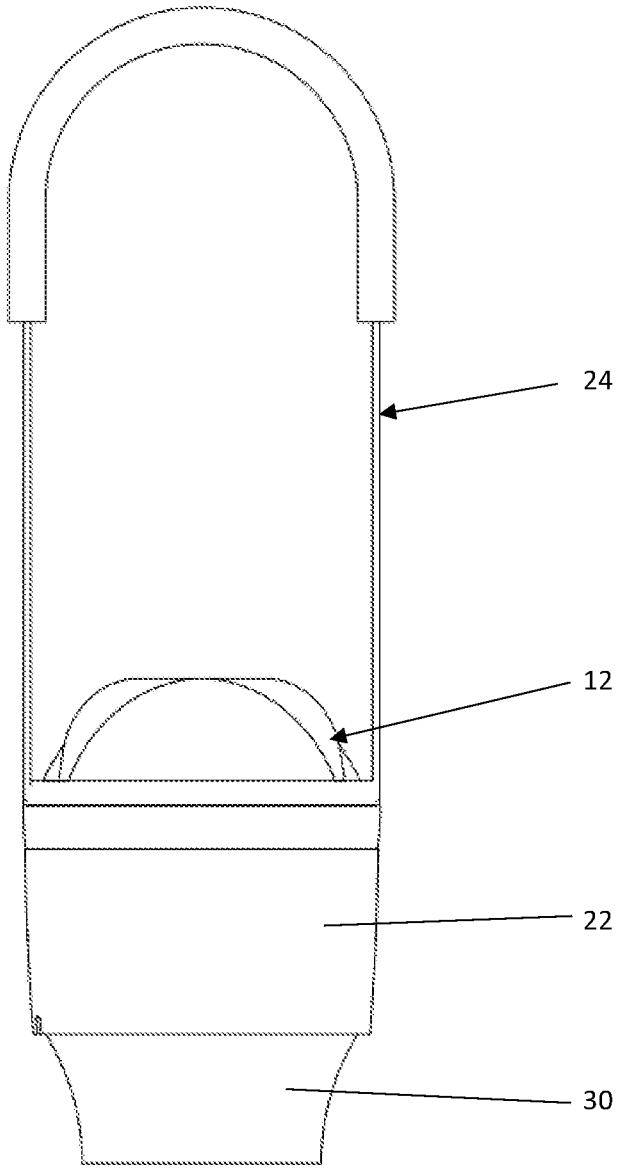
FIG. 3 is a side view of the first embodiment.
Figure 4:
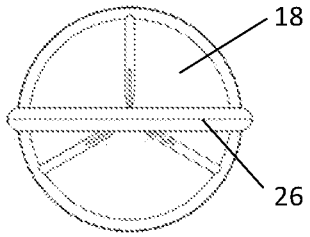
FIG. 4 depicts a top end view of the first embodiment.

During the freezing process, the mold 12 can be held in a retainer 20. The retainer 20 is configured to help the mold retain its shape during expansion due to freezing. The retainer 20 sits in a cup portion 22 of a mold extractor assembly 23. The lower side of the retainer 20 includes a hollow portion 31 configured to receive air and liquid during the freezing process. More specifically, the retainer 20 is configured to contain air upon loading into the vessel and allows the ingress of liquid through annular opening 13 if the optional toothpick holder (described below) is not installed and/or through the four apertures 60 during the freezing process as internal pressure within the vessel increases from ice formation and the resulting expansion. As is shown in FIGS. 2 and 5B, the cup portion 22 of the embodiment of FIGS. 1-7 includes a side wall 63 with an inner wall surface 64 and an outer wall surface 65, and an annular lower wall 34 with a central opening 66. In the embodiment shown in FIGS. 1-7, the mold extractor assembly 23 includes the retainer 20, the cup portion 22, and a handle 24 formed from a strong wire 25 which forms a large loop with a lower end portion 28 that extends through a pair of apertures 32*a*, 32*b* in the lower wall 34 of the cup portion 22, and an upper end portion 29 that has a gripping portion 26 formed thereon to be gripped when the mold assembly is extracted from an insulated vessel 104 (shown in FIG. 8A).

A ring-shaped cushion sleeve 30 is removably mounted to the lower wall 34 of the cup portion 22. The cushion sleeve 30 is tapered in a downward direction and has an annular hollow side wall 37. A plurality of apertures 54*a*, 54*b*, 54*c* and a plurality of curved slots 56*a*, 56*b* and 56*c* are included on the lower wall 42 of the cushion sleeve 30. These apertures and slots initially provide for the annular space 35 inside of the cushion sleeve wall 37 to be filled with air when freezing begins, but then the annular space 35 becomes partially filled with liquid as the liquid in the mold 12 expands upon freezing. During expansion, liquid moves outwardly from the mold 12 through lower mold opening 44 and into the annular space 35 through apertures within the cushion sleeve 30. The tapered design of the cushion sleeve 30 provides the clearance necessary to prevent undesirable interference with the host vessel that would otherwise prevent the extractor assembly from appropriately nesting for ideal functionality. The annular space 35 is defined by an inner side surface 39 of an outer wall 38, an inner side surface 43 of the lower wall 42, and an inner side surface 41 of an inner wall 40. A space 46 is provided inside of the tapered, annular inner wall 40 of the cushion sleeve 30.

In the embodiment shown in FIGS. 1-7, the cushion sleeve has a pair of upwardly extending ring segments 47*a* and 47*b* configured for an interference fit into a pair of complementary curved slots 48*a* and 48*b* formed on the lower wall 34 of the cup portion 22 of the mold extractor assembly 23. In other embodiments that are not shown, there are three upwardly extending ring segments on the cushion sleeve and three complementary curved slots on the lower end of the cup portion, and in some embodiments there is an upwardly extending ring on the cushion sleeve that fits into a ring-shaped slot on the lower end of the cup portion. Techniques other than an interference fit also can be used to removably connect the cushion sleeve to the cup portion.

Figure 5A:
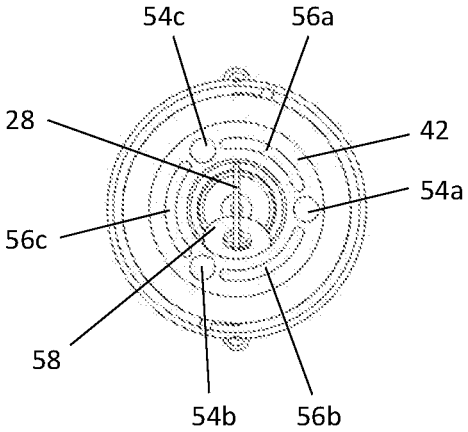
FIG. 5A shows a bottom end view of the first embodiment.
Figure 5B:
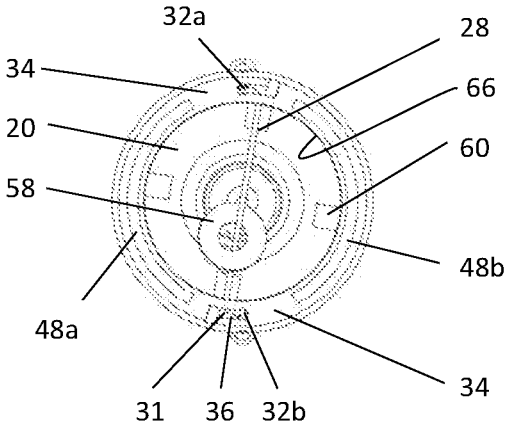
FIG. 5B shows the bottom end view with the cushion sleeve removed.
Figure 6:
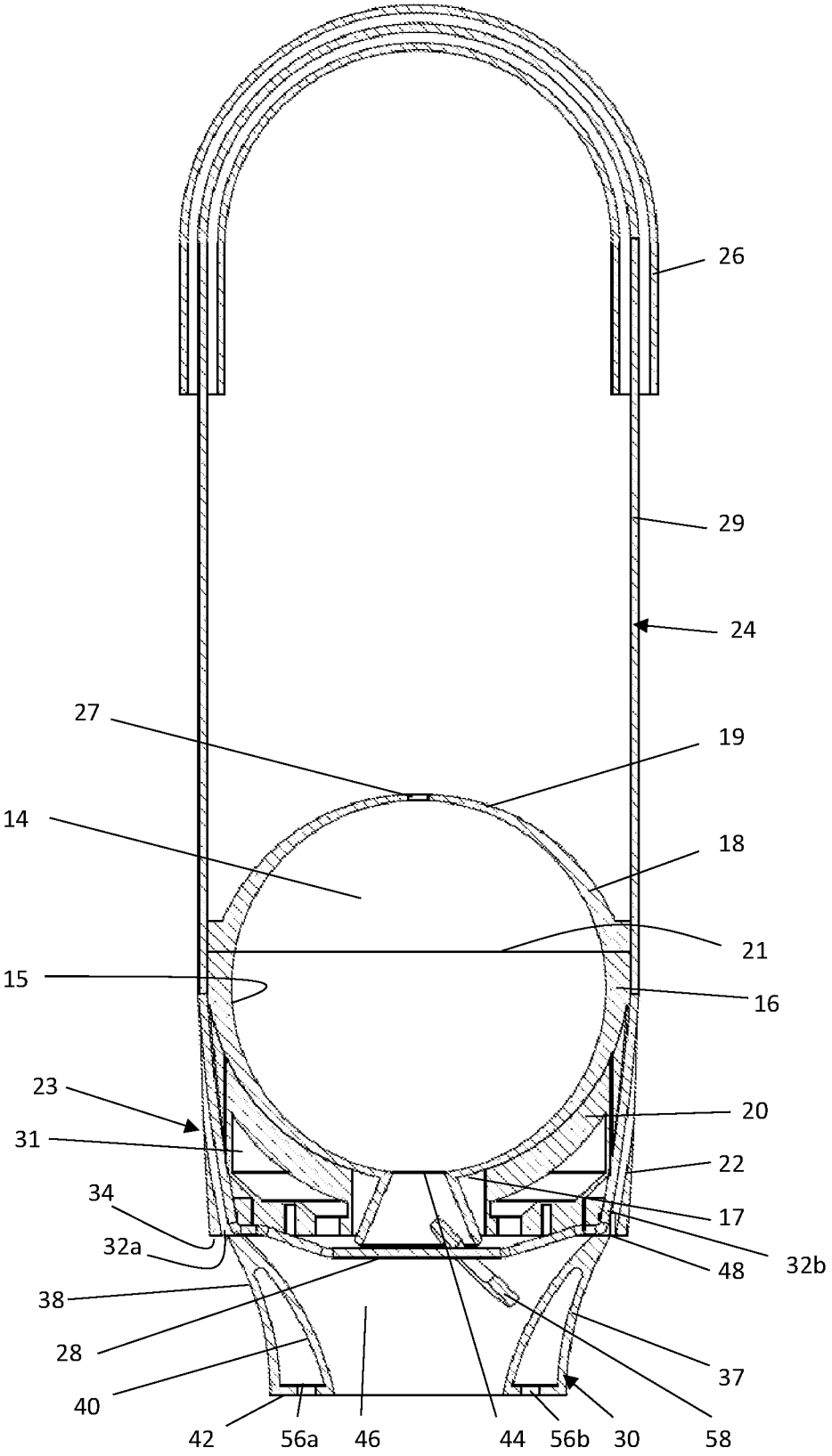
FIG. 6 shows a side sectional view of the first embodiment.
Figure 7:
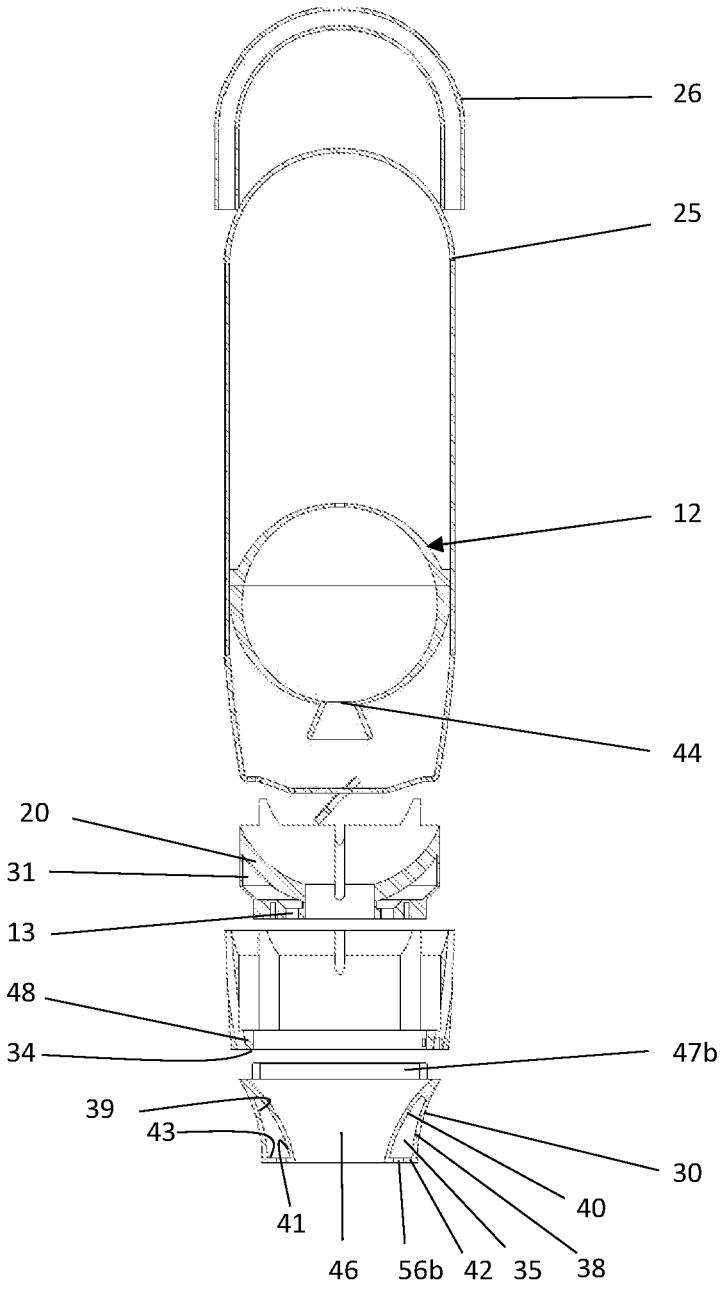
FIG. 7 shows an exploded side sectional view of the first embodiment.

As is shown in FIGS. 5A and 5B, three apertures 54*a*, 54*b* and 54*c*, which can be circular, are formed on the lower wall 42 of the cushion sleeve and are configured to slowly allow for the flow of liquid into the annular space 35 during expansion that results from freezing. Three apertures 56*a*, 56*b* and 56*c*, which can be curved, also are included on the lower wall 42 of the cushion sleeve 30. Apertures 54*a*, 54*b*, 54*c*, 56*a*, 56*b*, and 56*c* are all configured to allow for the ingress of liquid into the annular space 35 during expansion that results from freezing. The other added functionality of the holes, 54*a*, 54*b*, and 54C is that they also serve as a provision to secure a vent tube 462 (shown in FIGS. 15-16D), when used, and maintain the position of the vent tube where the open end of the vent tube is high up in the annular space to prevent ice from forming and clogging it. The use of a vent tube equalizes the pressure and helps reduce or eliminate the potential of having the extractor assembly become vacuum locked in the host vessel.

The lower end portion 28 of the wire 25 includes a tensioning/lock segment 36, shown in FIGS. 2 and 5B, that prevents any interference between the wire and cushion sleeve when the mold extractor assembly 23 is installed. The tensioning lock segment 36 also keeps the wire taught to support an ice depth indicator, such as a ring 58 and allows the ring 58 or other ice depth indicator to freely slide back and forth when the vessel is slightly tilted as a rudimentary means to detect depth of freeze in certain applications. Other configurations alternatively can be used for the ice depth indicator. Ring 58 can be a washer that optionally is installed on the wire handle to serve as a provision for detecting the depth of freeze in certain applications, such as slug and cube where line of sight can be maintained. In some cases, the ring 58 comprises stainless steel. As is shown in FIG. 5B, which illustrates the lower wall 34 of the cup portion 22, channels 48*a* and 48*b* are the female channels of the extractor in which the male ring/ring segments 47*a* and 47*b* on the cushion sleeve 30 interference fit into to join the cushion sleeve 30 to the cup portion 22.

Figure 8A:
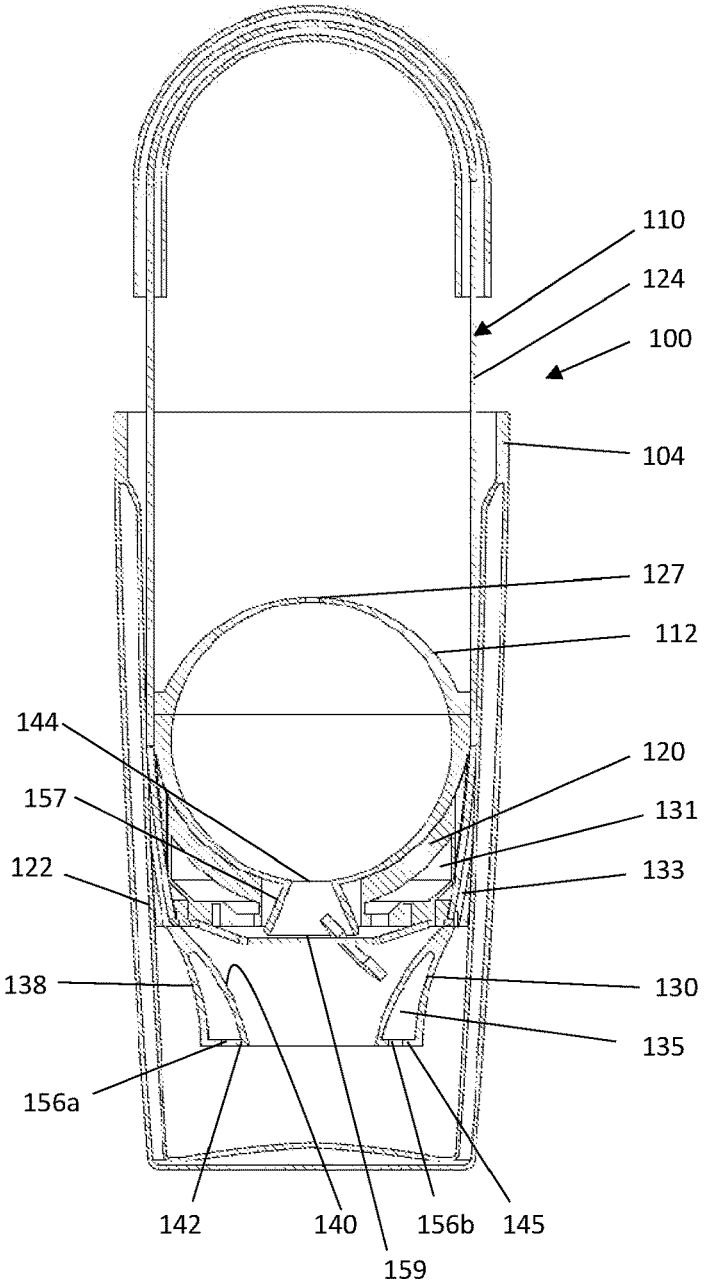
FIG. 8A shows a side sectional view of the first embodiment in a container.
Figure 8B:
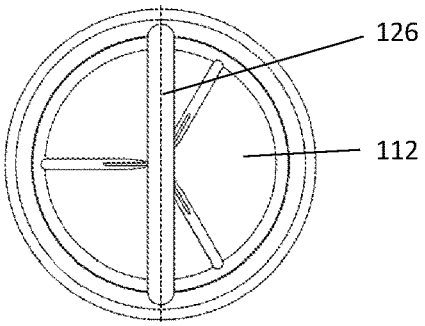
FIG. 8B shows a top view corresponding to FIG. 8A.
Figure 8C:
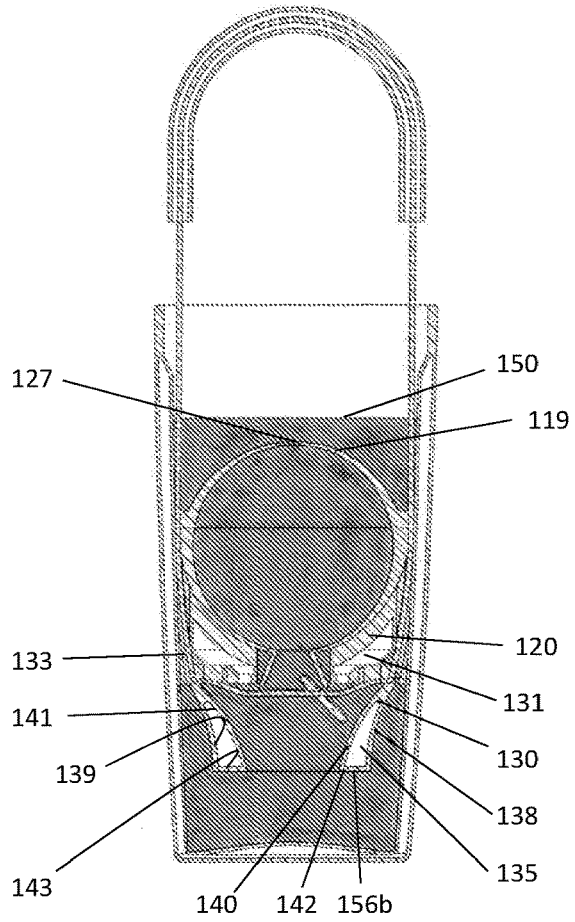
FIGS. 8C-8F show liquid and ice levels at various stages during the freezing process.

FIGS. 8A-8F illustrate a variation of the first embodiment in which a mold assembly 110 similar to that shown in FIGS. 1-7 is disposed in an insulated vessel 104. As is indicated in FIG. 8A, the system including the insulated vessel 104 and the mold assembly 110 is generally designated as 100. FIGS. 8C-8F show water and ice levels at various stages during the freezing process. Due to the expansion of water when it freezes, the ice occupies a larger volume in the vessel 104 than the water (or other liquid) which forms the ice. Liquid, usually water, is added to the mold 112 through an aperture 127, and additional liquid can be added until the mold 112 is completely beneath the water level 150, i.e. the water level is slightly above the upper second end portion 119 of the upper second portion 118 of the mold 112. Alternately, the host vessel may be prefilled with liquid and mold assembly 110 can be installed afterwards, thus filling mold 112 from the bottom up through aperture 144. An outwardly extending frustoconical funnel portion 157 optionally may be included as part of the mold 112 adjacent to aperture 144 that includes an opening 159 at the end with a larger diameter as a provision to maintain proper mold aperture alignment within retainer 120 to allow for unobstructed ingress and egress of liquid throughout the process.

When a liquid is initially placed into the mold and vessel (or the assembly is dropped and submerged into a host vessel that is already prefilled with liquid), an annular space 131 serves at this time as an air pocket in the retainer 120. Additionally, an annular air pocket is formed in the annular space 135 in the cushion sleeve 130, the annular space 135 being defined by the inner side surface 139 of outer wall portion 138, inner side surface 141 of inner wall portion 140, and inner side surface 143 of lower wall 142 of the cushion sleeve 130.

Figure 8D:
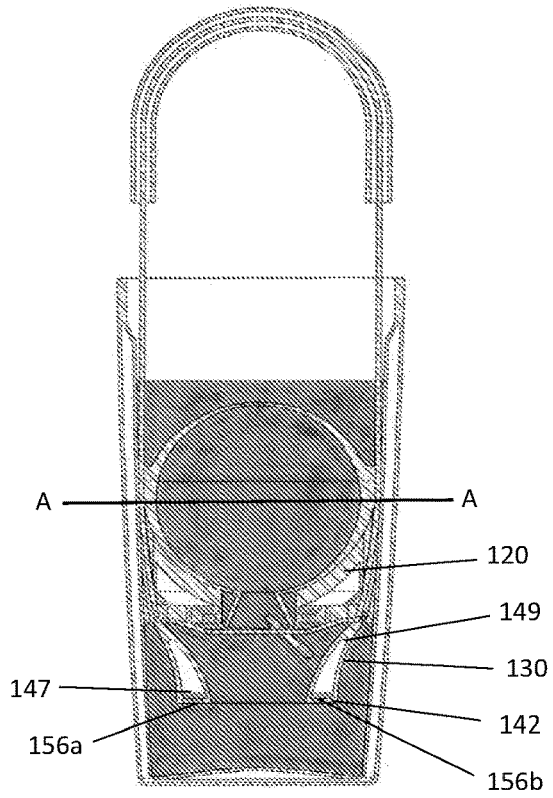

As used herein, the term "ice" refers to frozen water and also to other frozen substances that are in liquid form at room temperature. When directional freezing begins, ice starts forming from the top end of the vessel, freezing progresses downwardly. In some exemplary cases, after about 11 hours, approximately 35%-45%, or about 40%, of the mold sphere contains ice, which is in the upper part of the mold, and about 55%-65%, or about 60%, of the mold sphere contains water. In FIG. 8D, line A-A approximates the location above which the mold contains ice. Due to expansion upon freezing, as ice is formed, liquid, such as water, begins to move upwardly inside the cushion sleeve 130 between the outer wall 138 and inner wall 140 of the cushion sleeve 130. The liquid enters the annular space 135 through the apertures 154*a*, 154*b* and 154*c* (154*b* is not shown, but corresponds to 54*b* in FIG. 5A). Liquid will also flow into annular space 135 through the 3 curved slots—56*a*, 56*b*, and 56*c* in FIG. 5A, formed in the cushion sleeve lower wall 142. As is shown in FIG. 8D, a quantity of liquid 147 occupies the lower portion of the annular space 135. In the illustrated embodiment, the liquid level extends about 20%-30%, or about 25%, of the distance from the lower wall 142 to the upper end 149 of the annular space 135. Furthermore, liquid begins to fill the lower end portion of the annular opening 131 into the annular space within 120. It is noted that a slower freeze generally results in clearer molded ice.

Figure 8E:
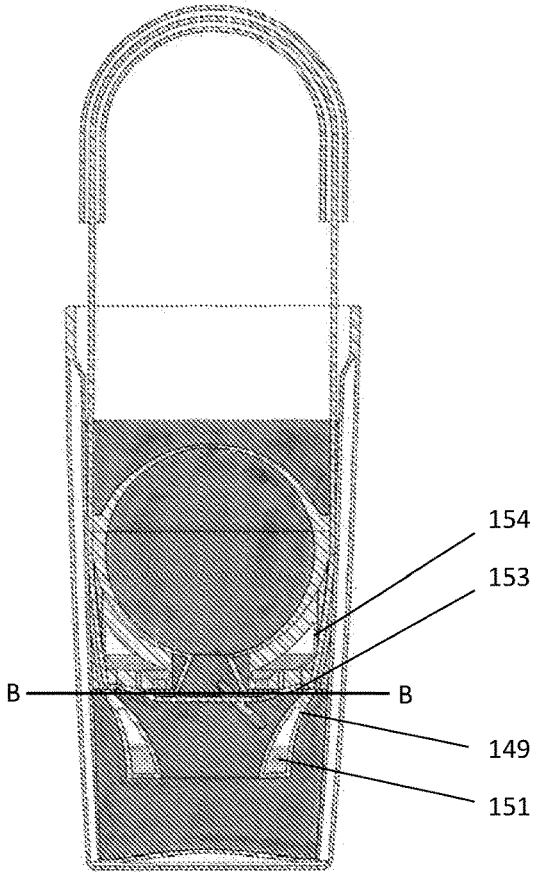

FIG. 8E shows one representative embodiment after the vessel has been in the freezer for about 23 hours. At this time, the entire spherical mold 112 is occupied by ice. The water level inside the annular space 135 in the cushion sleeve 130 extends approximately 45%-55%, or about 50%, of the distance from the lower wall 142 to the upper end 149 of the annular space 135. Ice is now present in the annular air pocket 131 up to a height of about 45%-55%, or about 50%, of the distance from the upper wall 153 of the cushion sleeve 130 to the upper end 154 of the annular air pocket 131. A quantity of liquid such as water 151 occupies the lower portion of the annular space 135. In the illustrated embodiment, the water level extends to a height of about 45%-55%, or about 50%, of the distance from the lower wall 142 to the upper end 149 of the annular space 135. Line B-B in FIG. 8E shows the ice-liquid interface in certain embodiments.

Figure 8F:
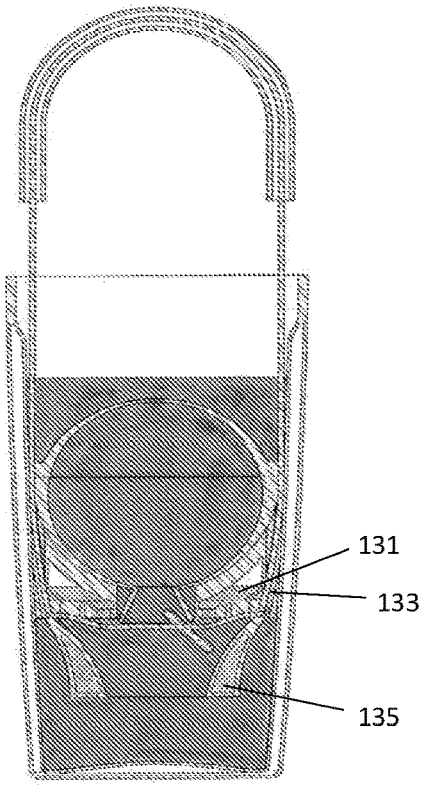

FIG. 8F shows one representative embodiment after the vessel 104 has been in the freezer for about 49 hours. Ice is now present throughout the insulated vessel 104, and in most cases no liquid is present at this point. The actual time required to fully freeze the liquid depend on total liquid volume, liquid temperature, freezer temperature, freezer positioning, internal garnishes, etc. Liquids other than water may have shorter or longer freezing times. The water (or other liquid) level inside the annular opening 135 in the cushion sleeve 130 extends approximately 90-95% of the distance from the lower wall 142 to the upper end 149 of the annular opening 137. Ice is now present in the annular space 131 up on a height of about 40-75%, or about 50-60% in the annular space 131. Ice is now present in the annular space 133. In embodiments, the access holes and/or slots to the annular spaces 131 and 135 freeze shut before the entire spaces 131 and 135 are filled with water.

The relative amounts of air in the annular openings will depend in part upon the absolute and relative dimensions of the vessel, mold and cushion sleeve. In certain embodiments of "20 oz" insulated containers, there is approximately 350 ml (~12 oz) of water or other liquid required to sufficiently submerge the mold assembly 10 as configured for making spherical ice (when also in use with the cushion sleeve as its volume serves as displacement). In embodiments, more liquid may be needed if the user opts to not employ the cushion sleeve. Ultimately the volume of liquid required will vary due to normal manufacturing variation of the host containers, the molds and the mold extractor. The configuration of the mold extractor and vessel will cause the mold extractor to sit higher or lower in the container, thus necessitating more or less liquid to optimally fill the vessel.

In certain embodiments to be used with a "20 oz" (591 ml) vessel, the cushion sleeve 130 has an approximate internal expansion volume of 12 ml and the annular opening in the retainer 20 has an approximate internal expansion volume of 23 ml. Collectively at 35 ml, they represent about 10% expansion space by total liquid volume. In embodiments, this ratio provides for a favorable balance in speed of freeze, clarity of ice formation, and ease of ice/apparatus extraction. Given that water expands by about 9% when freezing, the designed 10% expansion volume also helps reduce the potential for aesthetic interior container damage from a "Full Freeze" or "Solid Freeze" condition when left in the freezer for far too long.

The disclosed embodiments are particularly useful for use with insulated cups and mugs configured to hold about 20-40 ounces of liquid. When using a 20 oz (591 ml) container, spherical mold, and cushion sleeve, with a starting water temp of ~33F and a freezer temp of ~0F, it has been found that ice forms at an average rate of ~3.5 mm per hour assuming a linear correlation. Given a number of variables, including volume of actual liquid at different depths through the container and extractor, extractor and container geometry changes, insulating effects of previously formed ice, etc.) the rate at which the ice is formed throughout the ~23 hour process (expanding & creating internal pressure) thus displacing portions of the remaining liquid into the expansion areas throughout the freezing process is quite dynamic and can be challenging to approximate. In some cases, the initial water fill level is about 4 inch above the top of the mold.

Figure 9:
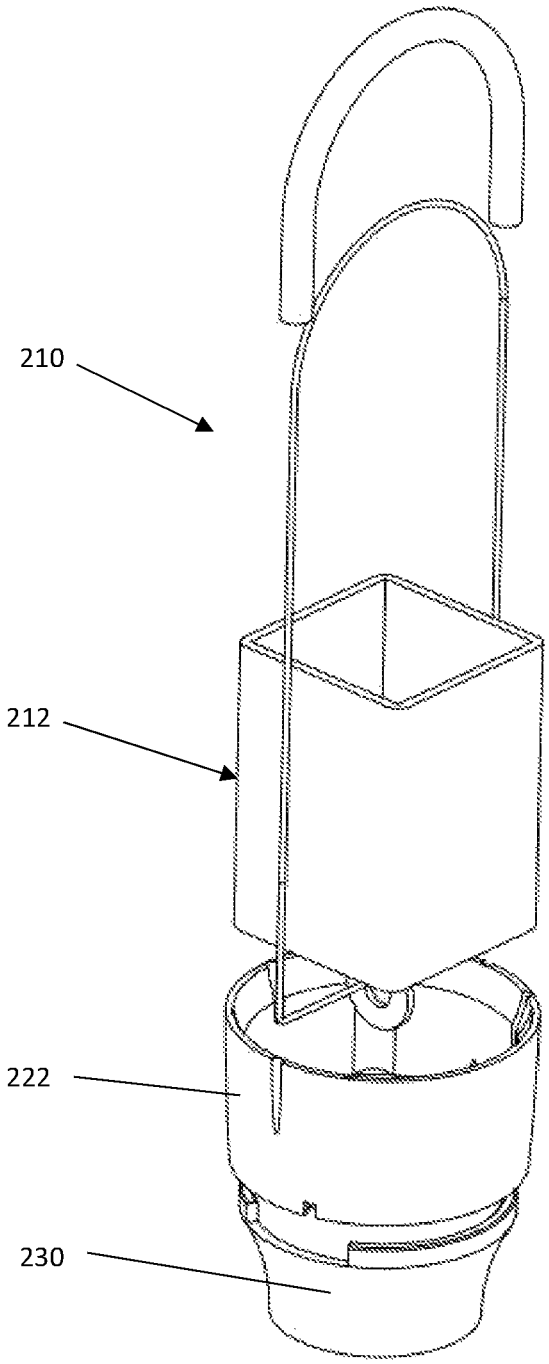
FIG. 9 is an exploded perspective view of a second embodiment.
Figure 10:
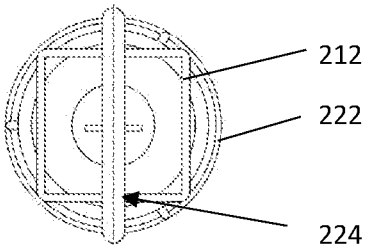
FIG. 10 shows a top end view of the second embodiment.
Figure 11:
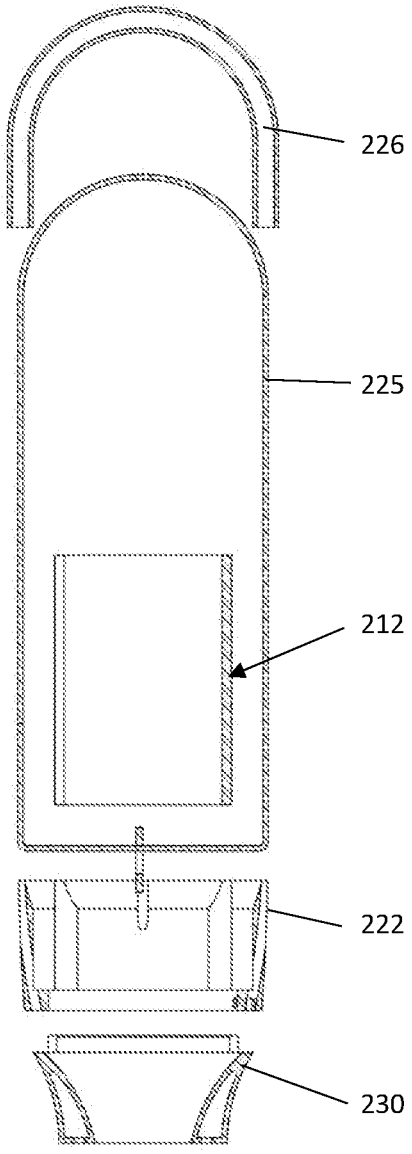
FIG. 11 is a side sectional view of the second embodiment.

FIGS. 9-11 show a second embodiment of a mold assembly, generally designated as 210. The mold assembly 210 includes a single rectangular slug-shaped mold 212, which can be used to make a slug of clear ice to subsequently be shaped by cutting or the like. It is noted that instead of a rectangular slug-shaped mold/square poly carbonate tube, a silicone mold can also be utilized here. The mold assembly also includes components similar to those of the first embodiment, including a cup portion 222, a cushion sleeve 230 and a handle 224 that includes a wire 225 and a gripping portion 226 formed over the upper portion of the wire 225. In view of the dimensions of the mold, a retainer is not employed as the mold is not likely to distort in shape when the liquid freezes.

Figure 12:
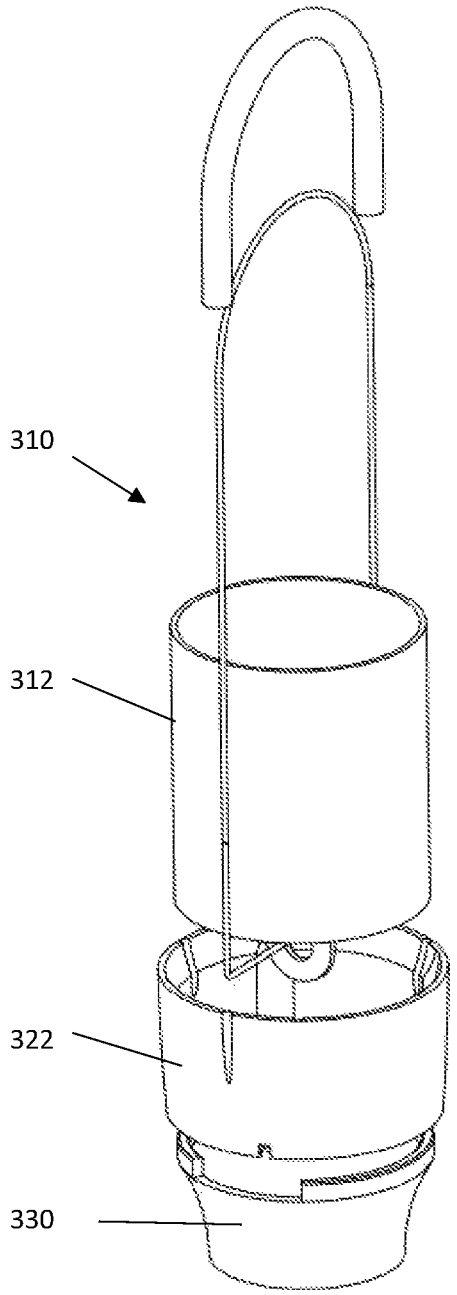
FIG. 12 shows an exploded perspective view of a third embodiment.
Figure 13:
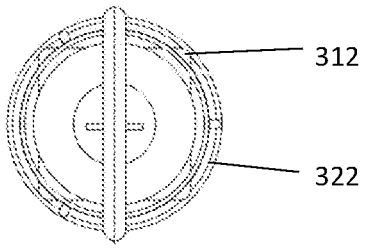
FIG. 13 shows a top end view of the third embodiment.
Figure 14:
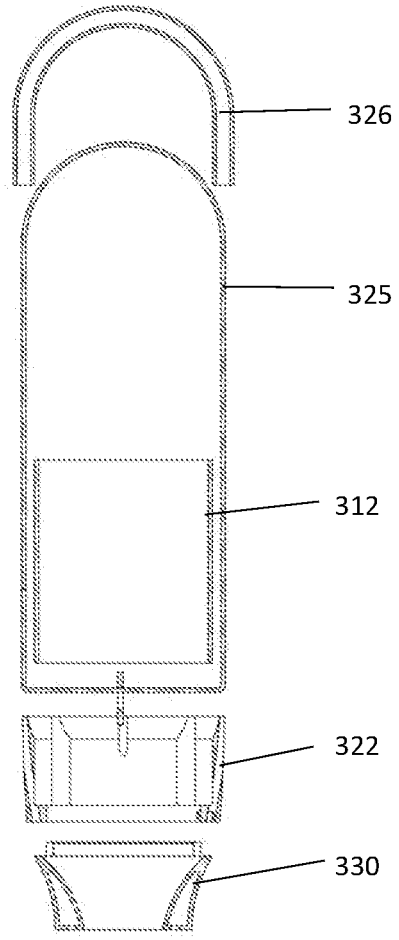
FIG. 14 is an exploded side sectional view of the third embodiment.

FIGS. 12-14 show a third embodiment of a mold assembly, generally designated as 310. The mold assembly 310 includes a single cylindrical slug-shaped mold 312, which can be used to make a slug of clear ice to subsequently be shaped by cutting or the like. The mold assembly also includes components similar to those of the first embodiment, including a cup portion 322, a cushion sleeve 330 and a handle that includes a wire 325 and a gripping portion 326 formed over the upper portion of the wire 325. This embodiment does not include a retainer.

Figure 15:
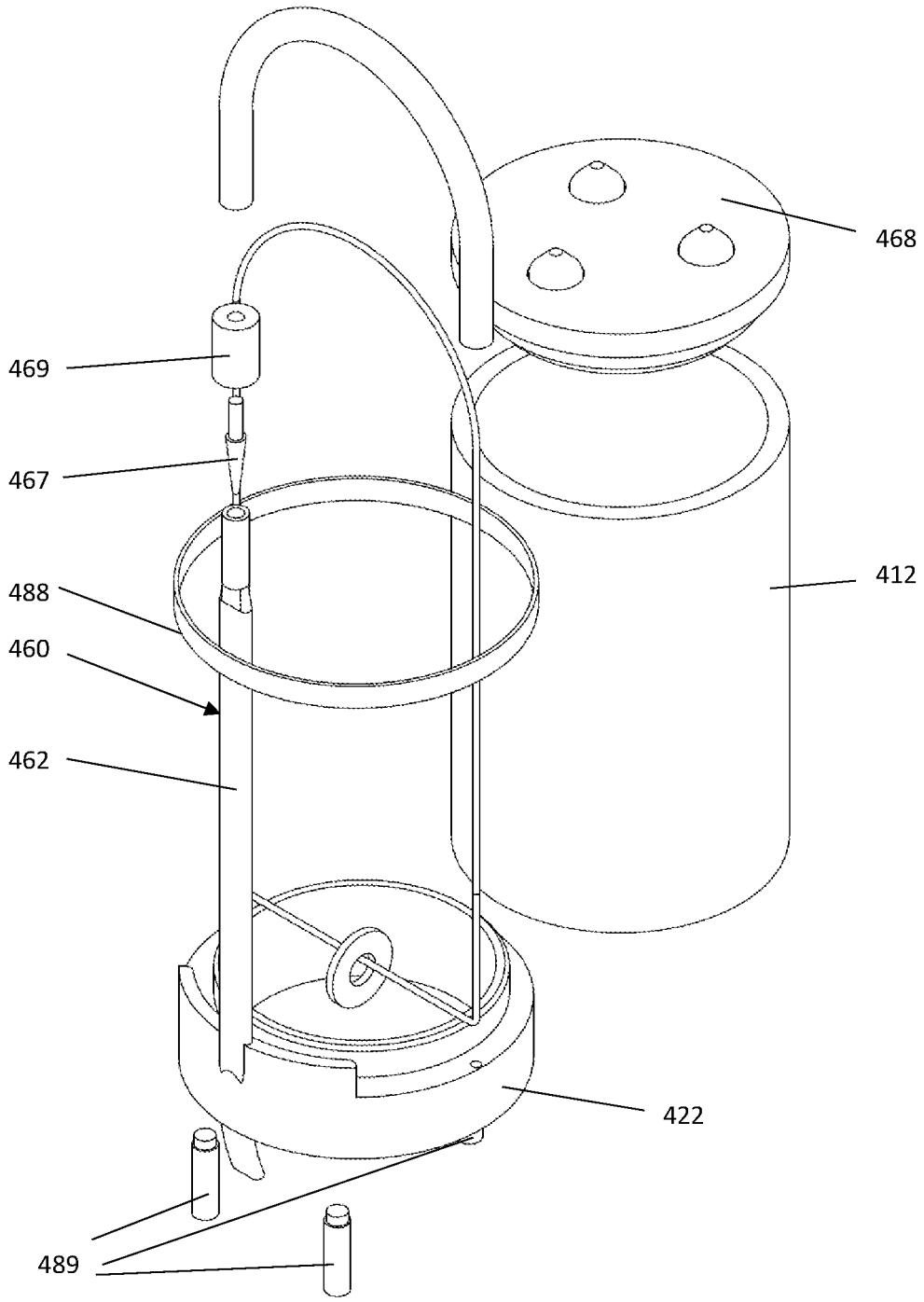
FIG. 15 is an exploded perspective view of a fourth embodiment.
Figure 16A:
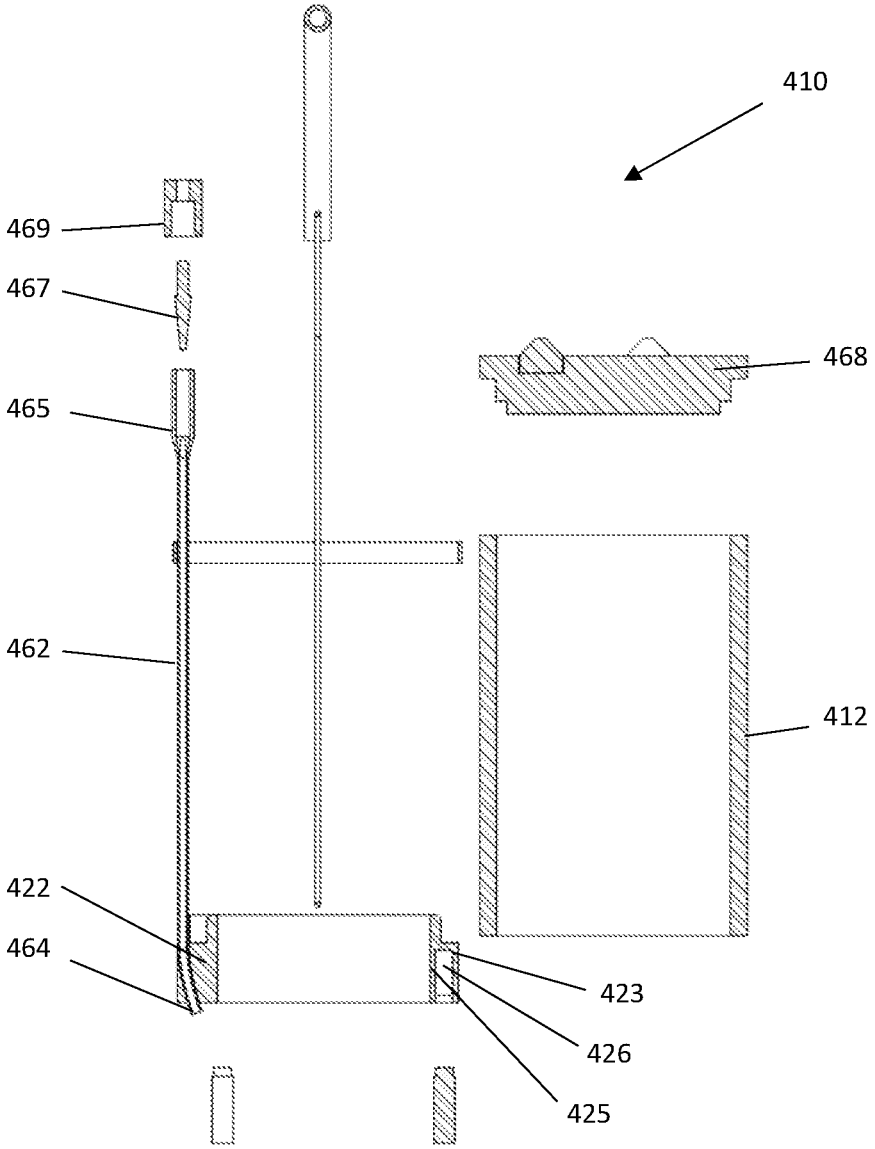
FIG. 16A is an exploded section view of the fourth embodiment.
Figure 16B:
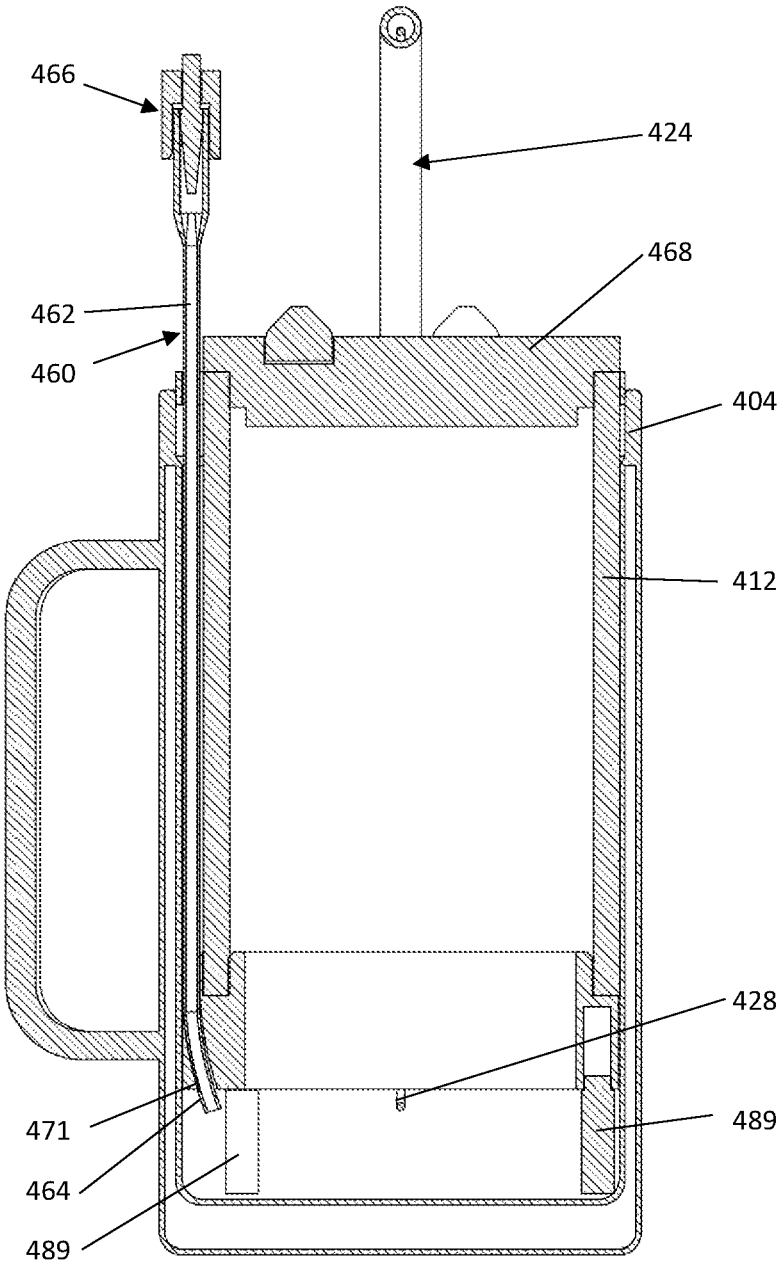
FIG. 16B is a section view of the fourth embodiment inside a vessel.
Figure 16C:
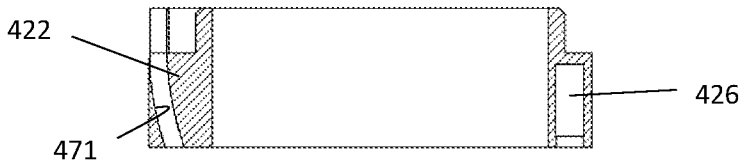
FIG. 16C illustrates details of the cup portion of the fourth embodiment.
Figure 16D:
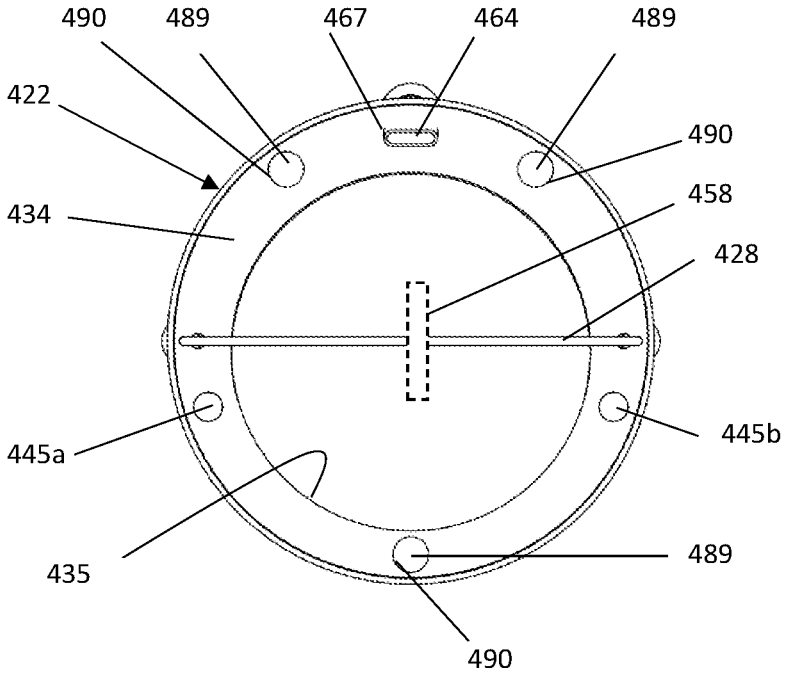
FIG. 16D shows a bottom view of the fourth embodiment.

The fourth embodiment shown in FIG. 15 and FIGS. 16A-16D is similar in some ways to that of FIGS. 12-14 in that the mold is for a cylindrical slug-shaped mold 412, but the embodiment of FIGS. 15-16D includes a vent 460. This embodiment is particularly well adapted for use with a vessel having non-tapered sides. The mold assembly 410 is positioned in a vessel 404, shown in FIG. 16B. The mold assembly 410 includes a mold 412, a cup portion 422 and a handle 424 with a lower end portion 428. The cup portion 422 has an outer side wall 423 and an inner side wall 425 defining an annular space 426 therebetween. The annular space 426 is C-shaped so as to not break through the oval-shaped or oblong aperture 467 for vent tube 462. The annular space 426 initially will be filled with air but can accommodate liquid as the pressure inside the vessel 404 increases and the liquid expands during the freezing process. The lower wall 434 of the cup portion has a central annular opening 435. A plurality of apertures 445*a*, 445*b* are formed in the lower wall to permit air, and later liquid, to enter the annular space 426. The vent 460 includes a flexible, re-usable tube 462 with a lower terminal end portion 464 configured to extend through channel 471 in the cup portion 422 and below the cup portion 422 into liquid (not shown) in the vessel 404, and an upper end portion 465 configured to extend upwardly above the slug-shaped mold 412. A plug 466 that includes a central portion 467 and an annular portion 469 prevents liquid from entering the tube 462 due to air pressure present in the tube 462. The plug 466 is removed when the mold is to be extracted in order to equalize the pressure within the vessel 404 that has built up as a result of the expansion forces during the freezing process. This eliminates the potential for the assembly to become vacuum locked and difficult to remove. The embodiment of FIGS. 15-16D optionally includes a lid 468 that can be used to reduce the likelihood that the ice at the top of the mold will melt too much at the beginning of the thawing process. This embodiment can include a band 488 extending around the outer periphery of the upper end of the mold 412 that usually is elastic, and can be made of rubber. The band 488 effectively shifts the center of gravity of the assembly to provide stability and prevents undesirable articulation when the user is holding the mold assembly 410 just by the handle 424, as the band 488 secures the handle 424 in two additional spots against the mold 412, higher up. The embodiment of FIGS. 15-16D optionally includes one or more supports 489 at the lower end of a sleeve-shaped cup portion 422 (three supports 489 are shown in the Figures) to provide a positive stop to optimally position the mold assembly 410 within the vessel 404 for ice formation, as there is no internal taper within the vessel 404 to vertically position the mold assembly 410. The supports 489 also maintain adequate clearance for the lower end of the vent 460, to prevent unintentional blockage which would defeat the functionality of the vent 460. In the embodiment shown in the Figures, the supports 489 fit in apertures 490 on the bottom wall 434 of the cup portion 422. If fewer than three supports 489 are used, empty apertures 490 serve the same function as apertures 445*a* and 445*b*. In embodiments, the mold assembly 410 is removed when the slug is fully ice and, if applicable, where optional ring 458, shown in broken lines in FIG. 16D, no longer moves.

Figure 17A:
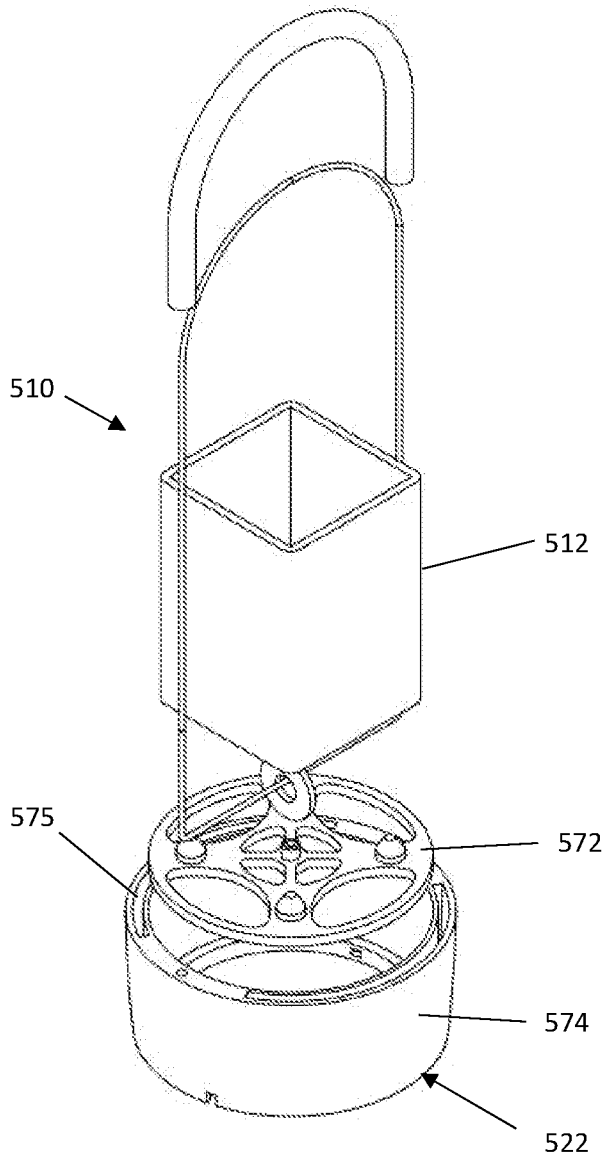
FIG. 17A shows an exploded perspective view of a fifth embodiment with a non-tapered lower end.
Figure 17B:
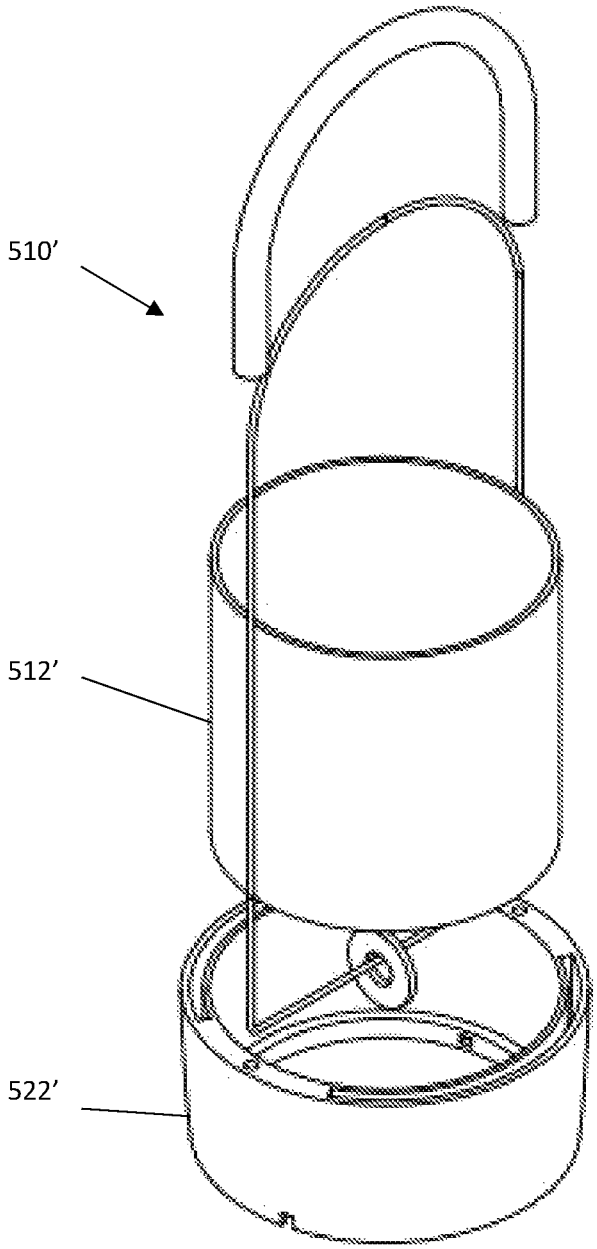
FIG. 17B shows an exploded perspective view of a variation of the fifth embodiment containing a cylindrical mold instead of a rectangular mold.
Figure 18:
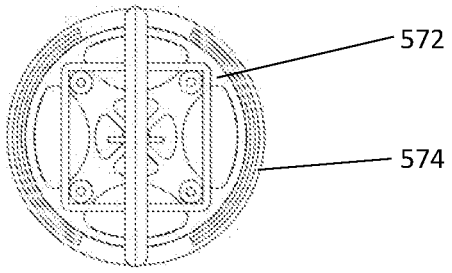
FIG. 18 is a top end view of the embodiment of FIG. 17A.
Figure 19:
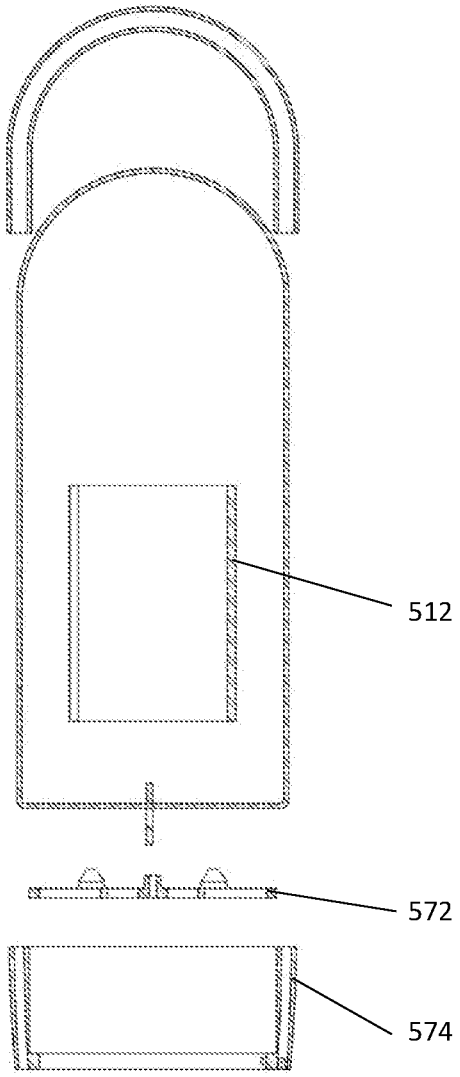
FIG. 19 is an exploded sectional view of the embodiment of FIG. 17A.

A fifth embodiment is shown in FIGS. 17A, 18 and 19 and is generally designated as 510. This embodiment employs a two-piece cup portion 522 that includes a base 572 and an annular side wall 574. A rectangular slug mold 512 is shown. The cup portion 522 is adapted for use with a larger vessel that has a tapered side wall, such as the YETI Rambler 30. Functionally, this embodiment is very similar to the first embodiment, however, the larger vessel calls for some different design elements and features, the most notable being the annular peripheral pass through slots 575 that allow the liquid in the vessel to flow freely through and around the apparatus to maintain equilibrium during loading/filling. The pass through slots 575 are particularly useful when making slugs. As is shown in FIG. 19, the mold 512 can be a 2"×2" poly carbonate tube, which rests on the base 572. The tube may have a rectangular cross section, as is shown in FIG. 17A, a circular cross section, or a cross section with another shape. A cylindrical tube similar to what is shown in FIG. 12 also can be used in place of the rectangular tube of FIG. 17A. This variation is shown in FIG. 17B, which illustrates mold assembly 510' with cylindrical mold 512' and cup portion 522'. The tube-shaped mold 512' fits snugly into cup portion 522' and therefore support 572 is not required. In the embodiment of FIGS. 17A, 18 and 19 (not being as space constrained as like with the second embodiment FIGS. 9-11), a larger mold also could be used. Furthermore, a silicone mold can be used in this embodiment. It is also noted that, as with the first embodiment, the embodiment of FIGS. 17-19 can also be configured with a retainer similar to retainer 20. In some cases, as with the embodiments shown in FIGS. 1-8F, the taper of the extractor and the selected vessel eventually seal off the liquid during the loading process and then the level of liquid within the tube is higher than that around the outside which requires the vessel to be topped off to ensure adequate directional freezing.

Figure 20:
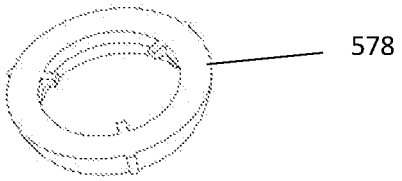
FIG. 20 shows a refreeze ring.
Figure 21:
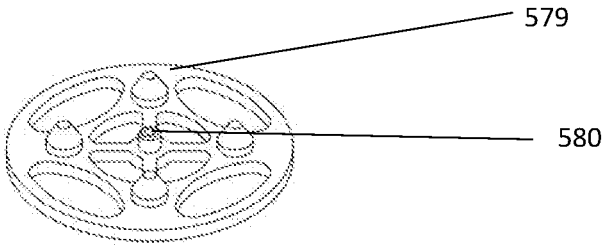
FIG. 21 shows a refreeze stand.
Figure 22:
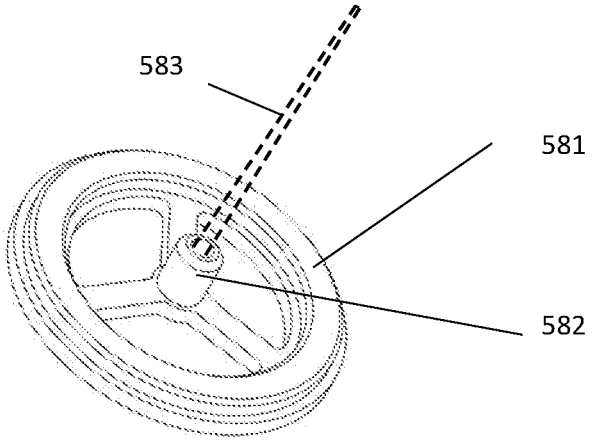
FIG. 22 shows a sphere toothpick holder.

FIGS. 20-22 show accessories that can be used in conjunction with the mold assemblies shown in FIGS. 1-19. FIG. 20 shows a refreeze ring 578 upon which an unused (or used, preferably after rinsing) sphere of clear ice can be set. The ring and ice sphere can be placed in a freezer for future use. FIG. 21 shows a dual purpose accessory comprising a stand 579 that can be used a refreeze a clear ice shape, and which also includes a support 580 for an elongated member 583 (shown in FIG. 22) to support a garnish or the like. Before water or another liquid is frozen into ice, the elongated member 583, such as a toothpick, needle, pin, wire, or similar object, can be mounted in the support 580 and a piece of fruit (or another item) can be mounted on the elongated member 583. The stand 579 can then be placed beneath a mold, with the garnish positioned in the mold with the toothpick extending through the lower opening of the mold in order to freeze the fruit into the center of the shaped clear ice. FIG. 22 illustrates another embodiment of a support 581 with a receiver 582 for the elongated member 583.

Figure 23:
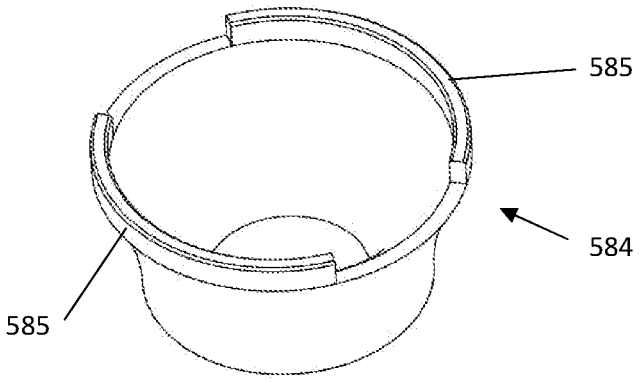
FIG. 23 shows a perspective view of a cushion sleeve.
Figure 24:
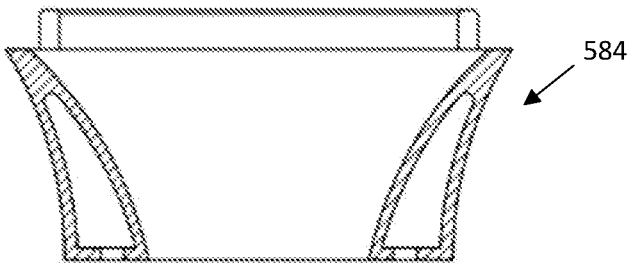
FIG. 24 shows a sectional view of a cushion sleeve.

FIGS. 23-24 show two views of a cushion sleeve such as is used in the embodiment of FIGS. 1-7. The cushion sleeve 584 has two arc-shaped ribs 585 formed on its upper end that are configured to be received in complementary grooves on a mold support, such as a cup portion or a retainer.

Figure 25:
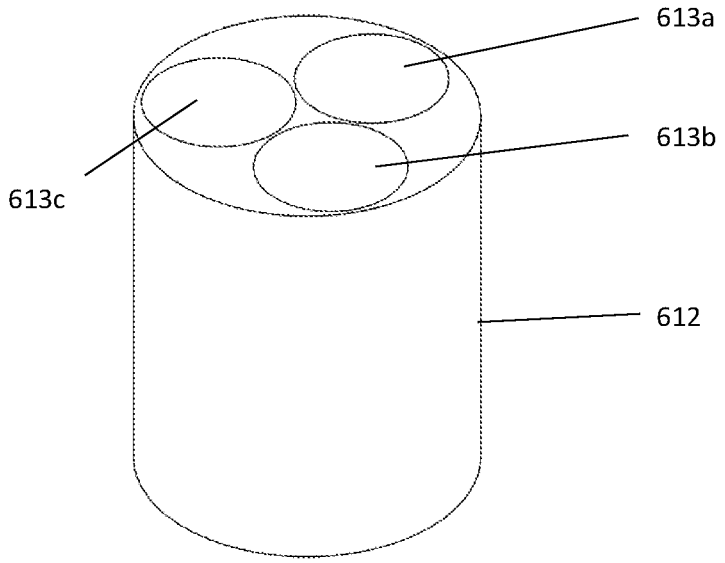
FIG. 25 shows a mold used to make three ice cylinders.

FIG. 25 shows a cylindrical slug-shaped mold 612 that can be used in the embodiment of FIGS. 12-14. This mold includes three elongated cylindrical cavities 613*a*, 613*b* and 613*c*, and is used to form 3 long and thin cylindrical ice shapes, as may be used when serving a Tom Collins drink. It is noted that the shape of the cavities can be varied. As non-limiting examples, the cavities also can be triangular, rectangular, hexagonal, octagonal, etc. in cross section, as is the case in other embodiments disclosed in this application.

Figure 26A:
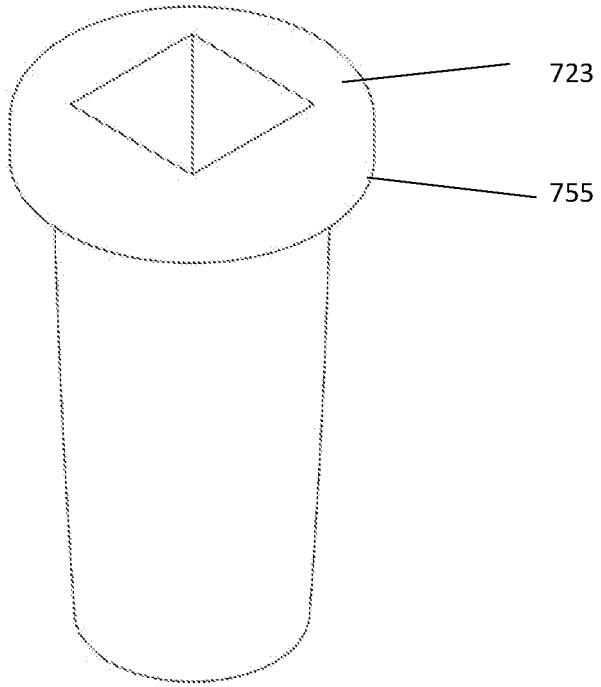
FIG. 26A shows a perspective view of a rectangular mold in accordance with a sixth embodiment.
Figure 26B:
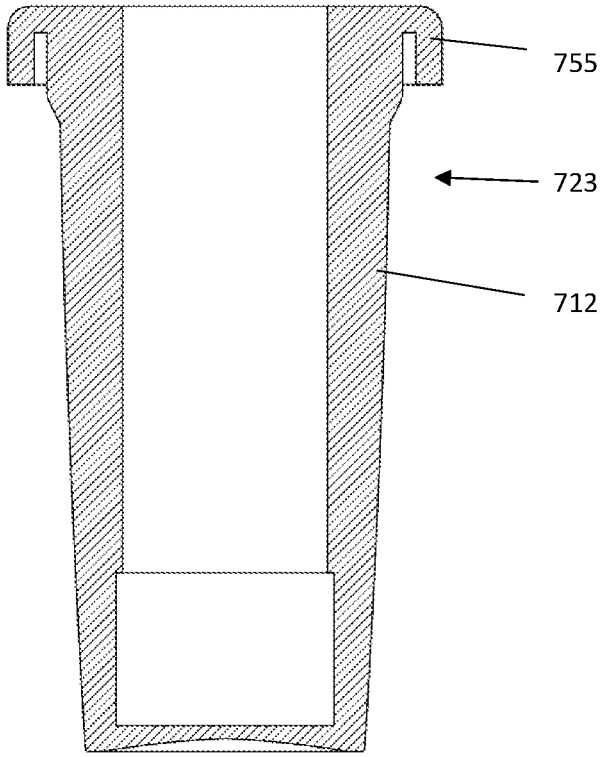
FIG. 26B shows a sectional view of the sixth embodiment.
Figure 26C:
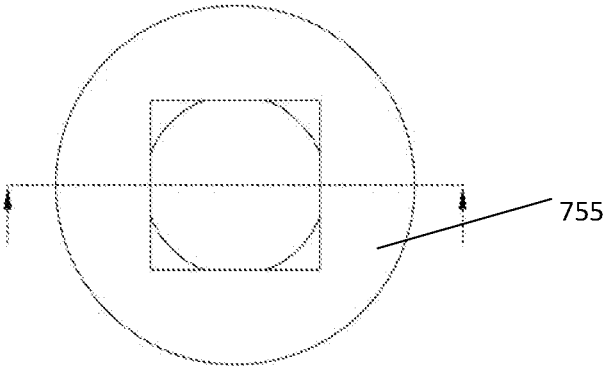
FIG. 26C shows a top view of the sixth embodiment.

In the embodiment shown in FIGS. 26A-26C, a mold extractor 723 is depicted that comprises an outwardly extending flange 755 instead of a handle. As is shown in FIGS. 26A-26C, the flange 755 is formed at an upper end of component 712, which either can be a mold itself or a mold support.

Figure 27A:
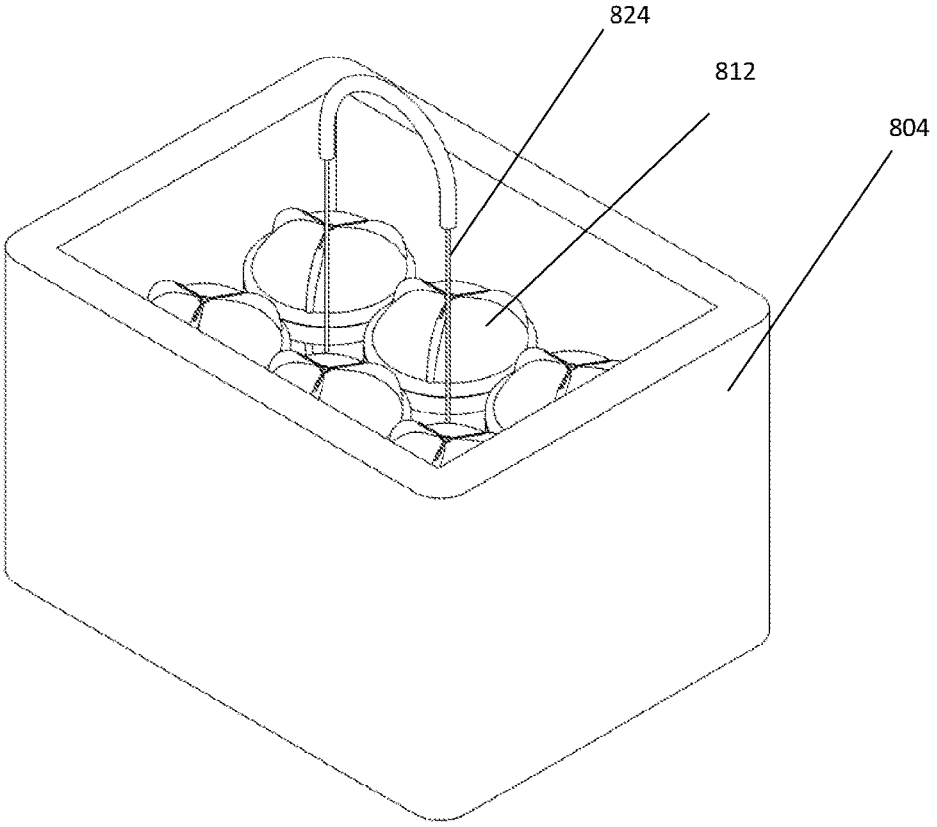
FIG. 27A shows a perspective view of a seventh embodiment with a rectangular configuration that contains a mold for making multiple ice balls at one time.
Figure 27B:
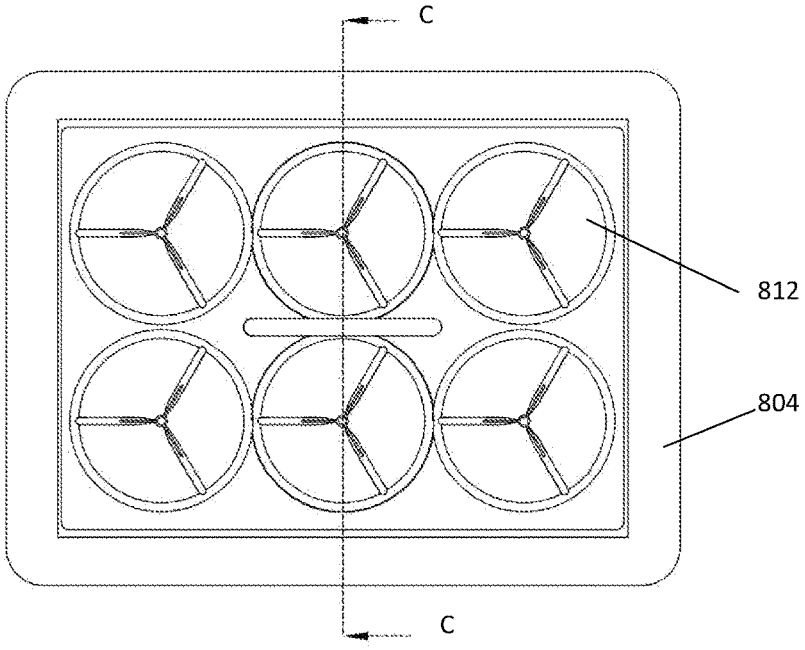
FIG. 27B shows a top view of the seventh embodiment.
Figure 27C:
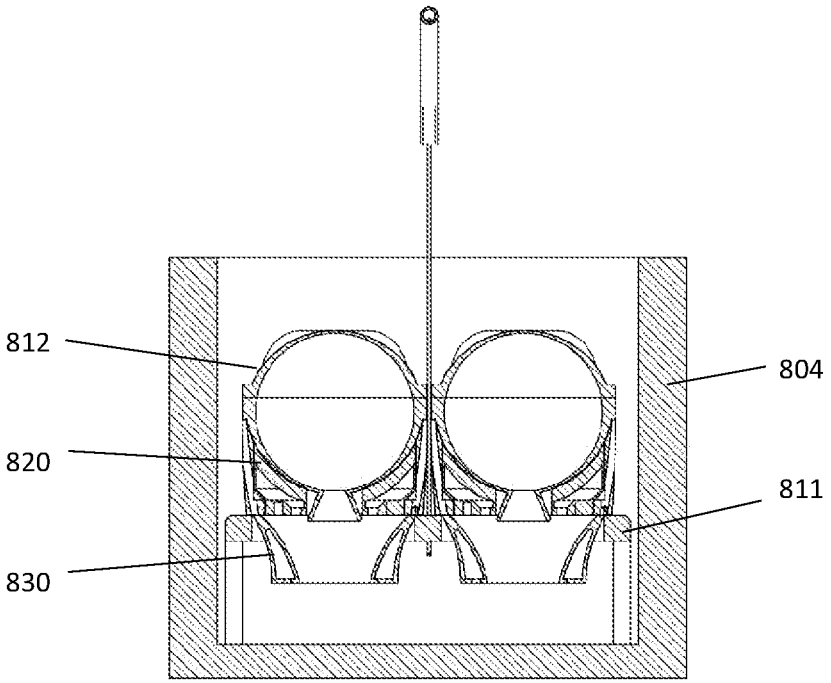
FIG. 27C shows a side sectional view of the seventh embodiment.

FIGS. 27A-27C show an insulated vessel 804 that is sized to contain 6 spherical molds 812 arranged in two rows of three molds each. A handle 824 is connected to a stand 811 that supports the six mold assemblies, each of which includes a mold 812, a retainer 820 and a cushion sleeve 830 similar to the components used in the embodiment of FIGS. 1-7. In this embodiment, square or rectangular molds, cylindrical molds or slugs, as well as other shapes can be used in place of spherical molds. Furthermore, fewer or more than 6 molds can be positioned in the vessel 804. In embodiments, the vessel is sized to received 4 to 12 molds, or 5 to 9 molds.

Figure 28:
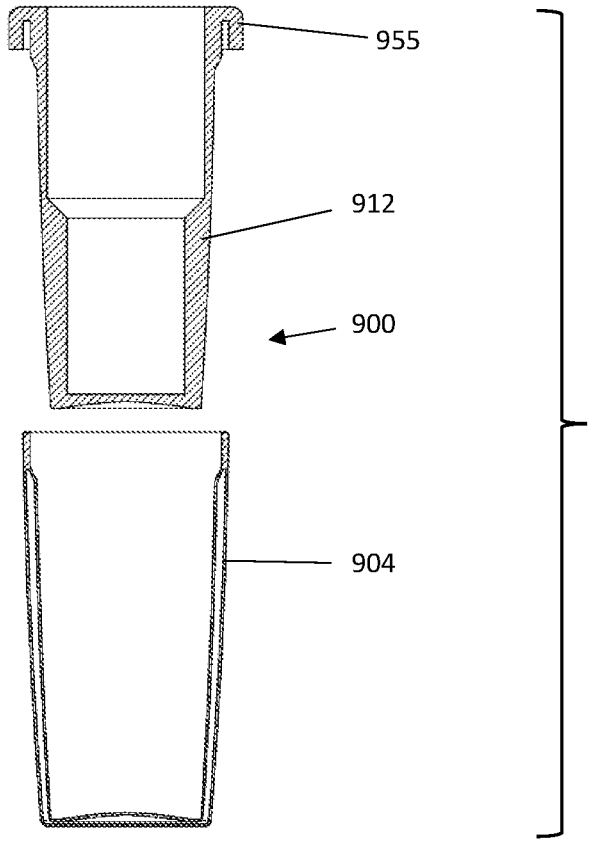
FIG. 28 shows a side sectional view of an eighth embodiment comprises a slug mold insert assembly.
Figure 29A:
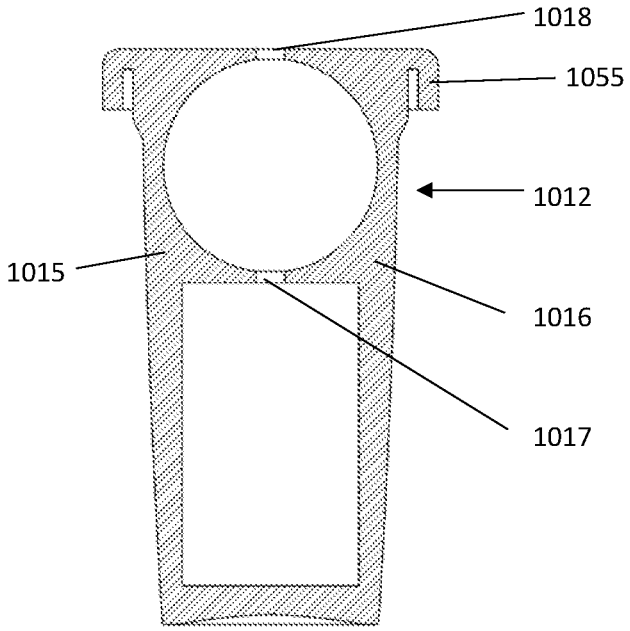
FIG. 29A is a side section view of a ninth embodiment that is a flexible 1-piece mold for a sphere.
Figure 29B:
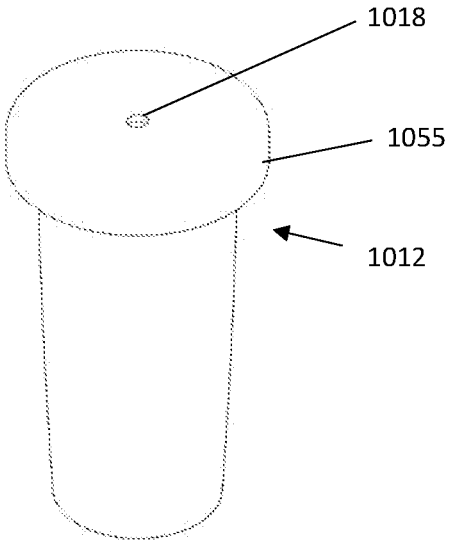
FIG. 29B is a perspective view of the ninth embodiment.
Figure 30A:
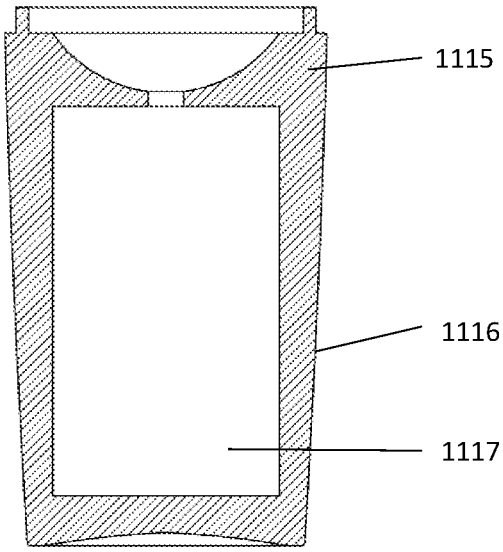
FIG. 30A is a side sectional view of the bottom portion of a sphere mold insert according to a tenth embodiment.
Figure 30B:
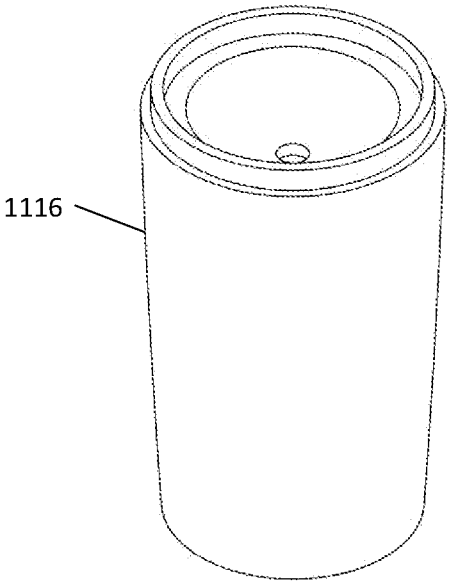
FIG. 30B is a perspective view of the bottom portion shown in FIG. 30A.
Figure 30C:
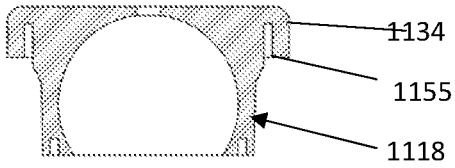
FIG. 30C is a side sectional view of the top portion of the tenth embodiment.
Figure 30D:
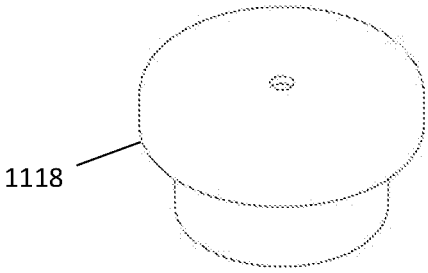
FIG. 30D is perspective of the top portion of the tenth embodiment.

FIG. 28 depicts a mold assembly 900 that includes a slug mold 912 with a flange 955 configured to enable the mold 912 to be removed from a vessel 904 after freezing. FIGS. 29A and 29B show a one-piece flexible spherical mold 1012 configured to be inserted in an insulated vessel. The mold can be manually removed from the vessel by pulling up from beneath the flange 1055. The flange is helpful to ensure a mold assembly registers it in the same location consistently and can be configured to have a diameter that maintains a snug fit within the internal diameter of the vessel. The molded ice can be removed through the highly elastic top opening, which can be stretched apart to pull out the molded ice. In an alternative configuration, the mold can have a vertical parting line along the top and side, and the shaped ice can be removed by pulling apart the left side 1015 (as shown in FIG. 29A) and right side 1016 (as shown in FIG. 29A) of the mold 1012 along lower aperture 1017 and upper aperture 1018.

FIGS. 30A-30D collectively show a 2-piece mold that employs a flange for extraction of the mold assembly from an insulated vessel. In this embodiment, the mold includes a lower mold section 1116 and an upper mold section 1118. The mold can be manually removed from a vessel by pulling up from beneath the flange 1155. The mold support 1115 is integrated with a cylindrical cavity 1117 beneath the spherical portion of the mold 1112.

Figure 31:
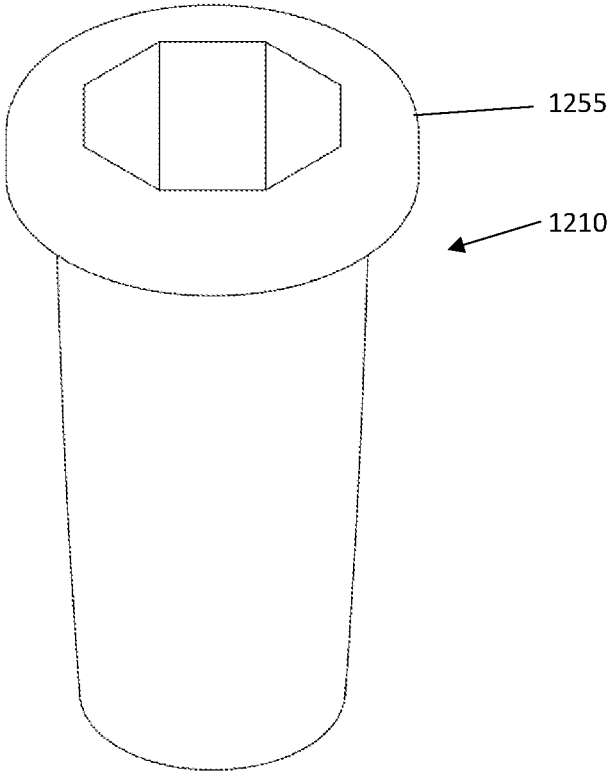
FIG. 31 is a perspective view of an octagonal mold insert according to a tenth embodiment.

FIG. 31 shows an octagonal mold assembly 1210 with a flange 1255. This mold can be used in conjunction with embodiments disclosed herein.

Figure 32:
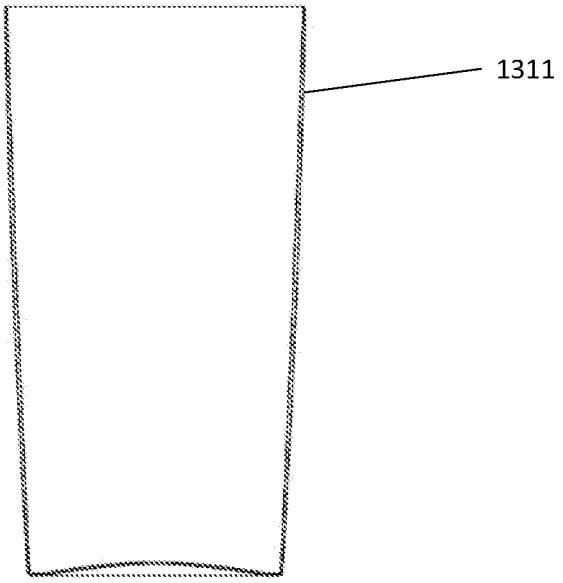
FIG. 32 is a slip liner according to an eleventh embodiment.
Figure 33:
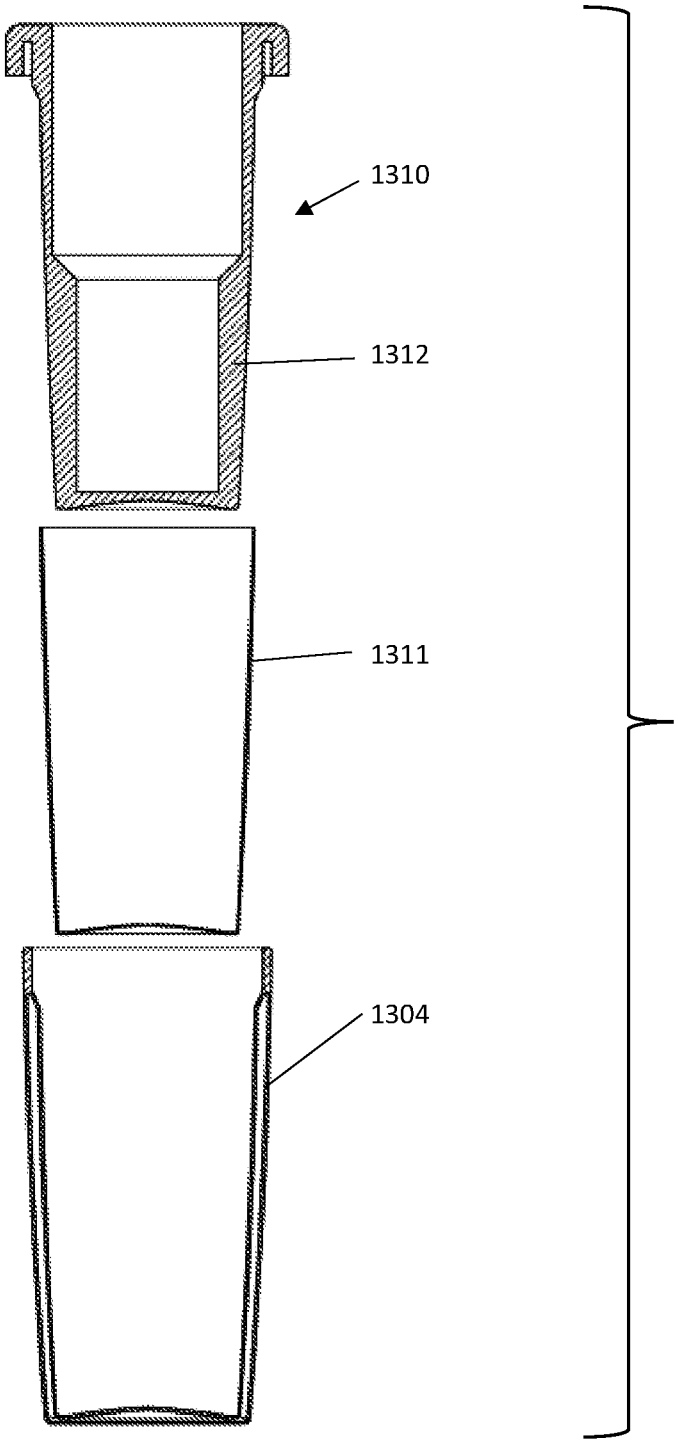
FIG. 33 is an exploded side section view of an assembly using the slip liner of the eleventh embodiment.

FIGS. 32-33 show an embodiment of a mold assembly 1310 that incorporates a slip liner 1311 in between a flanged mold 1312 similar to that shown in FIG. 28 and an insulated vessel 1304. The slip liner 1311 optionally can include a vent similar to that shown in the embodiment of FIGS. 15-16D. In embodiments, the liner can be made of a soft material in order to enable the mold assembly to be used in combination with various commercially available cups and mugs. In embodiments, the liner is made of a low surface tension material to facilitate extraction. In other cases, the liner is made of a hard material, such as a metal. In most cases, the liner is made from a material having a low coefficient of friction. Two or more liners can be stacked, one inside the other.

Figure 34:
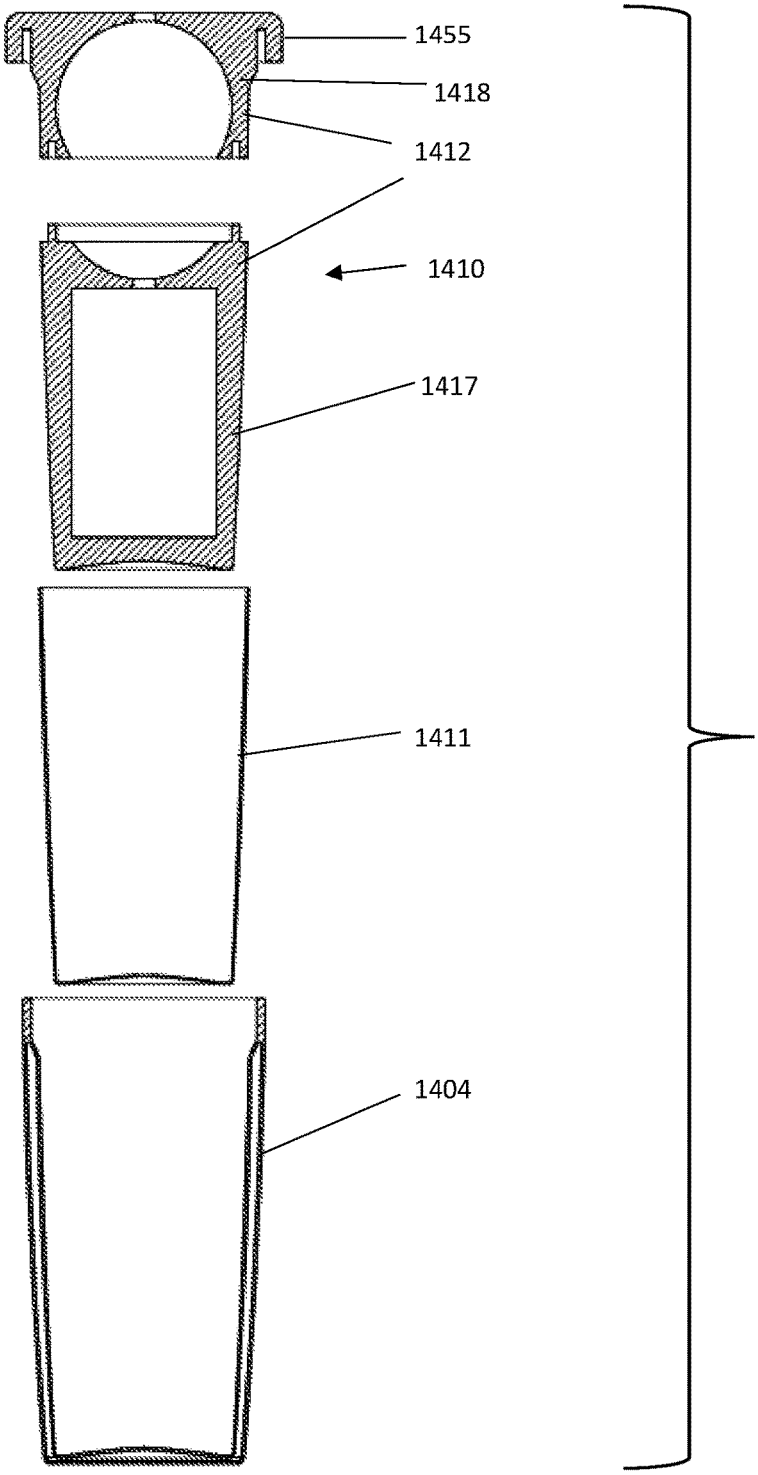
FIG. 34 is an exploded side sectional view of another assembly using the slip liner of the eleventh embodiment.

The embodiment of FIG. 34 is similar to that of FIGS. 32-33 in that a slip liner is used. The embodiment of FIG. 34 employs a spherical mold similar to that shown in FIGS. 30A-30D that includes a lower first portion 1417 and an upper second portion 1418 that has a flange 1455 along its upper edge. A slip liner 1411 is positioned between an insulated vessel 1404 and the mold 1412. The mold is placed in an insulated vessel 1404. In the embodiments of FIGS. 32-34, in some cases the slip liner itself extends further up to the top, or lower down toward the bottom, than in the illustrated embodiment.

Figure 35A:
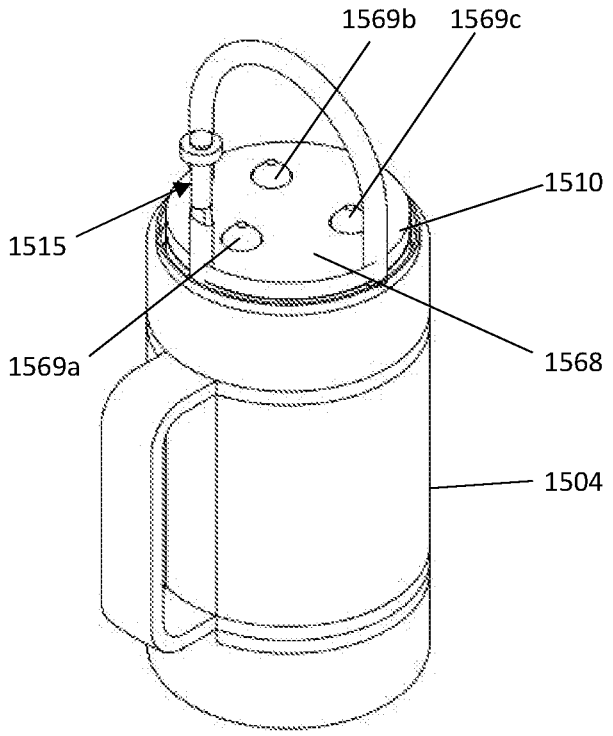
FIG. 35A shows a perspective view of a twelfth embodiment that includes an ice depth sensor.
Figure 35B:
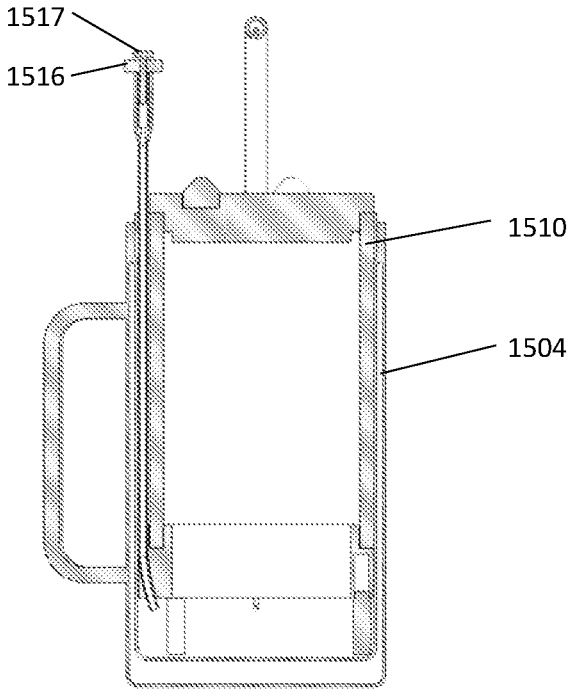
FIG. 35B shows a side section view of the twelfth embodiment.

FIGS. 35A-35B show a mold extractor assembly 1510 that includes a pressure indicator 1515 that indicates to a user when the ice is frozen to a sufficient depth. Pressure inside vessel 1504 builds up as the water or other liquid changes to ice. The pressure indicator 1515 includes a sleeve 1516 and a central portion 1517 that slides or "pops" up when the pressure within the vessel 1504 reaches a certain predetermined level. In other cases, as is shown in FIGS. 1-7, a washer, which may be made of stainless steel, can be an indicator for slugs and cubes where line of sight can be maintained throughout the process. The pressure indicator 1515 also can be used in conjunction with the washer. The embodiment shown in FIGS. 35A-35B includes a lid 1568 to prevent early melting of the top layer of ice in the mold. The lid 1568 also can be used as a refreeze support for molded ice, in which case the lid is placed inside the insulated vessel 1504 and a piece of molded ice is placed on the protrusions 1569*a*, 1569*b* and 1569*c* on the top surface of the lid 1568. The embodiment shown in FIGS. 35A-35B can be similar in construction to the embodiment of FIGS. 15-16D with the exception that the tightness of the fit between the sleeve 1516 and the central portion 1517 is carefully selected such that the central portion 1517 will move upwardly relative to the sleeve 1516 when the internal pressure of the vessel reaches a target level during the freezing process, the internal pressure being indicative of the desired amount of solid (ice) vs. liquid in the vessel.

Figure 36A:
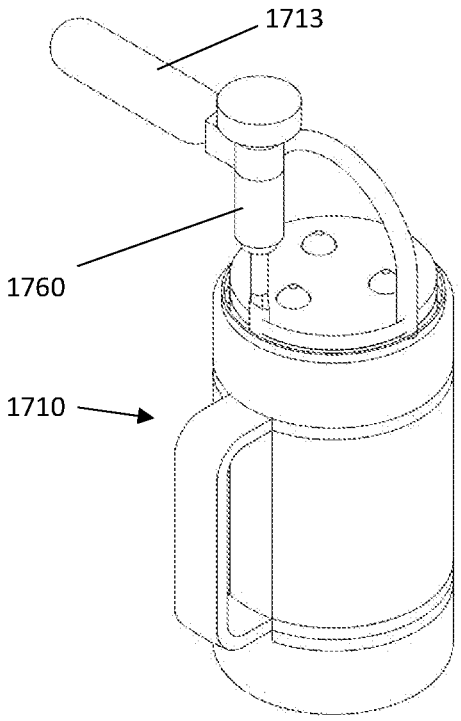
FIG. 36A shows a perspective view of a thirteenth embodiment that includes a carbon dioxide cartridge to assist in mold removal.
Figure 36B:
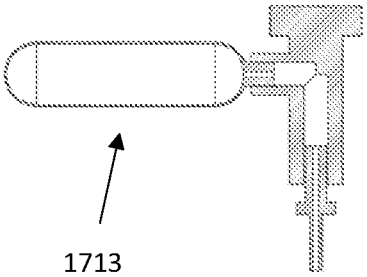
FIG. 36B is a side sectional view showing the details of the cartridge of FIG. 29A.

FIGS. 36A-36B show a mold assembly 1710 that includes a carbon dioxide cartridge. Carbon dioxide can be injected into the vessel to facilitate extraction. In order to deliver the carbon dioxide, the plug (not shown) is removed from the vent 1760 and carbon dioxide is injected into the top end of the vent 1760 and is delivered to the bottom of the vessel. Pressure from the carbon dioxide pushes the mold extractor upwardly in the insulated vessel.

Figure 37A:
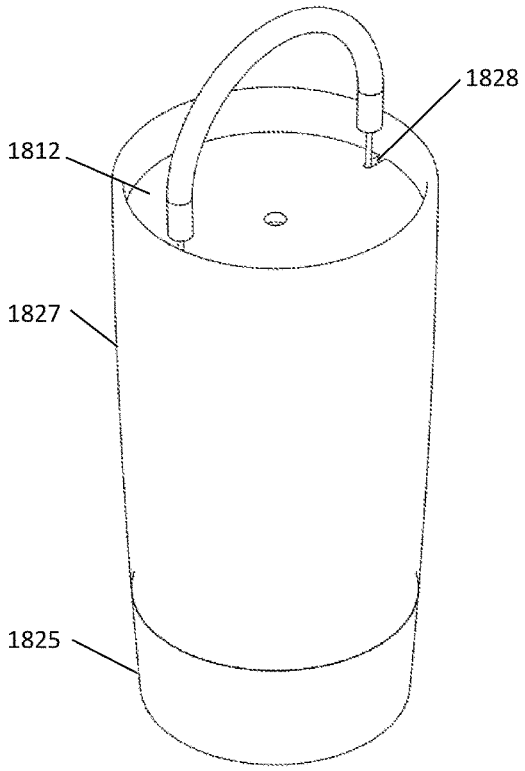
FIG. 37A shows a perspective view of a submersible 2-piece mold with liner and extra bottom exterior piece according to a fourteenth embodiment.
Figure 37B:
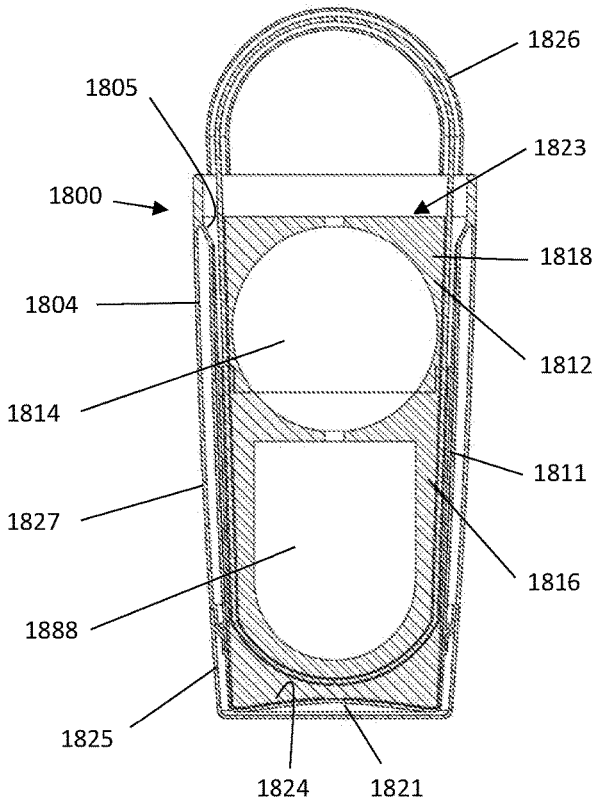
FIG. 37B shows a side sectional view of the fourteenth embodiment.

FIGS. 37A-37B show an assembly 1800 that includes a tapered insulated vessel 1804 containing a liner 1811 and a mold extractor assembly 1823. The vessel 1804 is filled with liquid to a level above the top of the shaped (in this case, spherical) portion of the mold 1812, i.e. above the upper end of the mold 1812. The liner 1811 is dimensioned to interface with the interior walls 1805 and interior bottom 1824 of the vessel 1804. The "domed" void 1821 shown in FIG. 30 is part of the interior geometry of the vessel 1804, to which the slip liner conforms. This embodiment uses vacuum insulation of the vessel 1804 to control freezing. During expansion, the liquid stays contained within the two-piece mold, which is formed by the upper mold portion 1818 and lower mold portion 1816. Much like the primary embodiments, this configuration benefits by being submerged and having the "ice cap" above the mold 1812 to prevent mold/ice deformation. The liquid continues to directionally freeze from the upper end to the lower end of the mold 1812 through the interior voids 1814 and 1888 of the mold halves 1818 and 1816. Having these mold halves 1818 and 1816 snugly fit into the liner 1811, which snugly fits into the host vessel 1804, prevents much of any mold/ice deformation as well as any "flashing" or "seepage" through the seam of the mold halves. In this embodiment, the liquid is completely contained within the mold halves (except for the "ice cap") and the host vessel is used for rigidity and insulating purposes to facilitate directional freezing.

In this embodiment, the user is able to remove the lower portion 1825 of the host vessel from the upper portion 1827, eliminating any vacuum. This configuration also allows the user to remove the lower portion 1825 and push the mold 1812 upwardly from the bottom as well as pull from the top using the wire handle 1826. The top mold portion 1818 has slots 1828 that allow it to be entirely removed off of the wire handle 1826, whereas the bottom mold portion 1816 can be permanently fixed to/with the wire handle 1826.

Figure 38A:
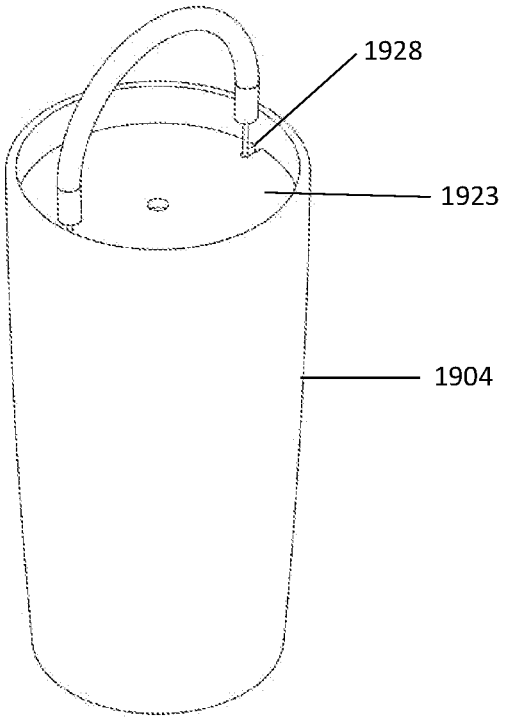
FIG. 38A shows a perspective view of a submersible 2-piece mold with liner and without an extra bottom exterior piece according to a fifteenth embodiment.
Figure 38B:
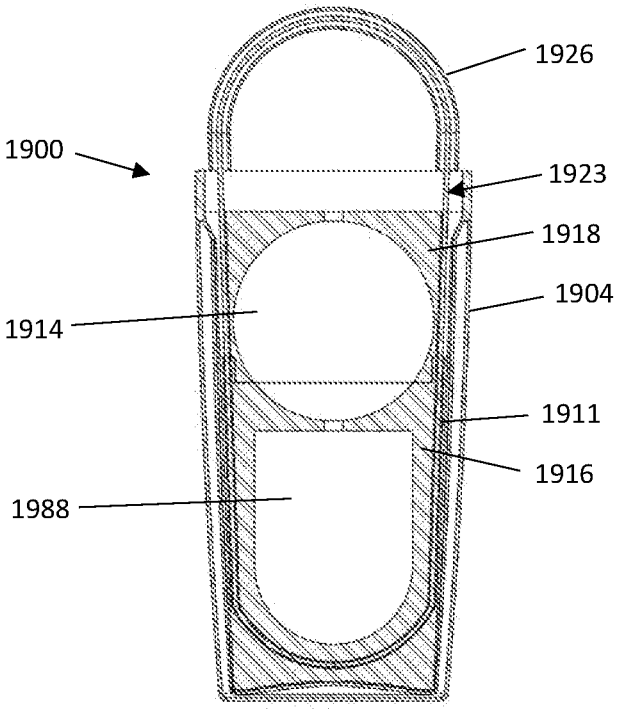
FIG. 38B shows a side sectional view of the fifteenth embodiment.

FIGS. 38A-38B show a system 1900 with a tapered insulated one-piece vessel 1904 containing a liner 1911, and a mold extractor assembly 1923. The liquid continues to directionally freeze from the upper end to the lower end of the mold 1912 through the interior voids 1914 and 1988 of the mold halves 1918 and 1916. The top mold portion 1918 has slots 1928 that allow it to be entirely removed off of the wire handle 1926, whereas the bottom mold portion 1916 can be permanently fixed to/with the wire handle 1926. In some cases, in connection with this embodiment, as well as the other embodiments disclosed and described herein, the slip liner itself extends further up to the top, or lower down toward the bottom, than in the illustrated embodiment.

Methods of Using the Mold Assembly

The assemblies and components described herein can be used to make clear ice in a variety of shapes, including but not limited to spheres, cubes, hearts, trees, stars, cylinders, rectangles, diamonds, jewels, sports balls, monograms, skulls, characters, flowers, symbols, etc. In embodiments, the methods include obtaining a mold extractor assembly having at least one of an extractor handle and an extraction flange, and a mold supported by the extractor, obtaining an insulated vessel configured to receive the mold extractor assembly, placing the mold extractor assembly in the vessel, adding a freezable liquid to the vessel such that the mold is at least partially submerged in the liquid, freezing the liquid using directional freezing to obtain shaped, clear ice. When water or another liquid is added to the container, it is advantageous to slightly tip the vessel to minimize splashing and reduce the likelihood of introducing bubbles into the vessel. It has been found that by filling the vessel such that the liquid level is about 4 inch above the top of the mold, the upper half of a spherical mold will retain its shape.

The optimal freezer temperature for molding ice in the disclosed embodiments is about 0 to about 5 degrees F. Before extracting molded ice, a room temperature thaw for 30 minutes to 2 hours is recommended. Thawing occurs more quickly if the mold extractor includes a vent.

Methods of Making the Mold Assembly

Components of the mold assembly typically are made from thermoplastic and/or thermoset materials. The components can be made by additive manufacturing or by molding. Compression molding, injection molding, blow molding, and a combination of molding techniques can be used for the various components. The molds themselves can be customized, or in some embodiments conventional molds can be used to make certain components.

Insulated Vessels

The mold assemblies described herein can be used with custom insulated vessels or with standard insulated cups sold for general use. One non-limiting example of a suitable insulated vessel that is commercially available for general use as a drinking cup is the YETI Rambler 20 oz. Other non-limiting examples of conventional insulated vessels include those sold by RTIC, Ozark, ORCA, Hydro Flask, Stanley 1913, etc.

Materials

A number of different food-grade materials can be used to make the components of the mold assembly. In embodiments rigid polycarbonate, PETG and/or flexible silicone materials are employed. Vent tubes can be formed from polyethylene. The extractor handle can be formed from stainless steel wire rope.

A number of alternatives, modifications, variations, or improvements therein may be subsequently made by those skilled in the art, which are also intended to be encompassed by the following claims.

What is claimed is:

1. A mold extractor, comprising:

a mold support configured to contact at least a first end portion of an ice mold during use, an extracting component configured to be manually lifted by a user to remove the ice mold from a vessel, the extracting component comprising at least one of:

a handle connected to the mold support and having an upwardly extending gripping portion, and a flange formed at an upper end of the mold support, and a cushion sleeve disposed adjacent the mold support and being configured to accommodate compressed air during volume expansion of liquid upon freezing.

2. The mold extractor of claim 1, wherein the mold support includes a cup portion configured to position the mold support in a stationary configuration in an insulated vessel.

3. The mold extractor of claim 1, wherein the mold support includes a retainer configured to retain the shape of the ice mold during the freezing process.

4. The mold extractor of claim 1, further comprising a mold having a cavity configured to produce shaped, clear ice, the mold including a first end portion and an opposite second end portion.

5. The mold extractor of claim 4, wherein the mold is configured to form at least one ice sphere or at least one ice cube.

6. The mold extractor of claim 4, wherein the mold is configured to form at least one of a cylindrical ice slug and a rectangular ice slug.

7. The mold extractor of claim 4 disposed in an insulated vessel, the mold extractor being configured to facilitate removal of the mold from the vessel after ice has been made.

8. The mold extractor of claim 7, wherein the mold extractor is configured to fit in an insulated vessel that has a tapered wall.

9. The mold extractor of claim 7, wherein the mold extractor is configured to fit in an insulated vessel that has a removable bottom wall.

10. The mold extractor of claim 7, further comprising a liner configured to be disposed between the vessel and mold support.

11. The mold extractor of claim 10, further comprising a vent mounted to the liner.

12. The mold extractor of claim 7, wherein the insulated vessel comprises at least one of a cup, a mug and an insulated box.

13. The mold extractor of claim 7, wherein the insulated vessel is configured to support the mold in a fully submerged configuration when liquid is placed in the vessel.

14. An assembly, comprising:

an ice mold having a cavity configured to produce shaped, clear ice, the ice mold including a first end portion and an opposite second end portion, a mold support configured to contact at least the first end portion of the ice mold, the mold support including a cup portion configured to hold the assembly in an insulated vessel in a stationary position, an extracting component comprising at least one of:

a handle connected to the mold support and having a gripping portion extending beyond the second end portion of the mold, a flange formed at an upper end of at least one of the mold and the mold support, and a cushion sleeve disposed adjacent the mold support and being configured to accommodate compressed air during volume expansion of liquid upon freezing.

15. The assembly of claim 14, wherein the mold support further includes a retainer disposed between the ice mold and the cup portion, the retainer configured to retain the original mold shape when liquid in the mold freezes.

16. The assembly of claim 14, further comprising at least one of the following accessories:

an ice refreeze mount, an elongated member configured to support a decorative item within shaped, clear ice, an ice depth sensor, a carbon dioxide cartridge, and a lid.

17. A mold extractor, comprising:

a mold support configured to contact at least a first end portion of an ice mold during use, an extracting component configured to be manually lifted by a user to remove the ice mold from a vessel, the extracting component comprising at least one of:

a handle connected to the mold support and having an upwardly extending gripping portion, and a flange formed at an upper end of the mold support, a liner configured to be disposed between the vessel and mold support, and a vent configured to be mounted to the liner.

18. The mold extractor of claim 17, wherein the mold support includes a cup portion configured to position the mold support in a stationary configuration in an insulated vessel.

19. The mold extractor of claim 17, wherein the mold support includes a retainer configured to retain the shape of the ice mold during the freezing process.

20. The mold extractor of claim 17, further comprising a mold having a cavity configured to produce shaped, clear ice.

* * * * *